US007751759B2

(12) United States Patent
Watanabe et al.

(10) Patent No.: US 7,751,759 B2
(45) Date of Patent: Jul. 6, 2010

(54) IMAGE FORMING APPARATUS WITH TONER CONTAINER LOCKING LEVER

(75) Inventors: Toshihiko Watanabe, Osaka (JP); Takashi Tamura, Osaka (JP)

(73) Assignee: Kyocera Mita Corporation (JP)

( * ) Notice: Subject to any disclaimer, the term of this patent is extended or adjusted under 35 U.S.C. 154(b) by 947 days.

(21) Appl. No.: 11/527,973

(22) Filed: Sep. 27, 2006

(65) Prior Publication Data

US 2007/0077097 A1 Apr. 5, 2007

(30) Foreign Application Priority Data

Sep. 30, 2005 (JP) ..... 2005-288990

(51) Int. Cl.
*G03G 15/08* (2006.01)

(52) U.S. Cl. ..... 399/262; 399/263

(58) Field of Classification Search ..... 399/120, 399/262, 263

See application file for complete search history.

(56) References Cited

U.S. PATENT DOCUMENTS 5,040,025 A 8/1991 Fukuchi
5,508,795 A * 4/1996 Kikuchi ..... 399/27
6,564,029 B2 * 5/2003 Kojima et al. ..... 399/258
6,609,599 B1 * 8/2003 Chang ..... 190/115

FOREIGN PATENT DOCUMENTS

JP 2002-278424 9/2002
JP 2004-45960 2/2004

* cited by examiner

*Primary Examiner*—David P Porta
*Assistant Examiner*—Bryan P Ready
(74) *Attorney, Agent, or Firm*—Gerald E. Hespos; Michael J. Porco

(57) ABSTRACT

An image forming apparatus is provided with an apparatus main body including a developing device, a toner container detachably mountable into the apparatus main body and adapted to replenish the developing device with toner particles, and a lever member settable to a locking position by a biasing force of a specified biasing member to interlock the toner container with the apparatus main body while being pressed down against the biasing force of the biasing member to unlock the toner container. The lever member has an operation surface to be pressed, and the operation surface includes an inclined surface sloped downward toward a side where an operator would face.

10 Claims, 12 Drawing Sheets

10
161
162
P
S1
11
112
121
122
122a
111
+Y
-Y
+X
-X
30K
30C
30M
30Y
30
365
110
48
S2
37
40
483

IMAGE FORMING APPARATUS WITH TONER CONTAINER LOCKING LEVER

BACKGROUND OF THE INVENTION

1. Field of the Invention

The present invention relates to an image forming apparatus provided with a toner container for replenishing a developing device with toner particles and used as a copier, a facsimile machine, a printer or the like.

2. Description of the Related Art

An image forming apparatus of the electrophotography type includes a charger, an exposing device, a developing device, a transfer device, a cleaning device and the like arranged around a photoconductive drum. An electrostatic latent image is formed on the outer circumferential surface of the photoconductive drum uniformly charged by the charger by illuminating this circumferential surface with a light having image information from the exposing device. A toner image is formed on the outer circumferential surface of the photoconductive drum by supplying toner particles from the developing device and is transferred to a sheet. The sheet having the toner image transferred thereto is fixed by heating in a fixing device disposed downstream of the photoconductive drum and then discharged to the outside.

In such an image forming apparatus, toner particles needs to be replenished since toner particles filled in the developing device is consumed in the developing process. There are generally the following two methods for the toner replenishment.

According to a first method, a developing unit integrally provided with a toner container is employed as a developing device and is replaced by a new one having toner particles filled in a toner container when toner particles runs out (see, for example, Japanese Unexamined Patent Publication No. 2004-45960). Contrary to this, according to a second method, a toner container for supplying toner particles to a developing device is provided and only the toner container is replaced by a new one without replacing the developing device when toner particles runs out (see, for example, Japanese Unexamined Patent Publication No. 2002-278424).

The first method not only leads to a cost increase due to the need to replace the still usable developing device every time toner particles runs out, but also forces the developing device to have a large capacity because of the content of toner particles to deal with at least about 4000 sheets by one replacement, which is against the tendency to make the apparatus smaller in size. Contrary to this, the second method provides a lower cost because only the toner container is replaced and accordingly does not make it necessary to enlarge the capacity of the toner container much, thereby contributing to the downsizing of the apparatus just by that much.

According to the second method, as disclosed in Japanese Unexamined Patent Publication No. 2002-278424, the toner container mounted into an apparatus main body is retained in the apparatus main body by means of a locking member such as a lock spring or the like, and this retained state is canceled by pressing an unlocking member. The unlocking member is in the form of a button, and an operator presses this button-shaped unlocking member with his fingertip, thereby canceling the interlocked state of the toner container with the apparatus main body. However, there has been a problem that the pressing operation cannot be smoothly performed by being hindered by the fingernail of the operator, for example, if the fingernail is too long.

SUMMARY OF THE INVENTION

It is an object of the present invention to provide an image forming apparatus provided with an operation lever enabling a toner container unlocking operation to be smoothly performed even if an operator has long fingernails.

In order to accomplish this object, one aspect of the present invention is directed to an image forming apparatus, comprising an apparatus main body including a developing device; a toner container detachably mountable into the apparatus main body and adapted to replenish the developing device with toner particles; and a lever member settable to a locking position by a biasing force of a specified biasing member to interlock the toner container with the apparatus main body while being pressed down against the biasing force of the biasing member to unlock the toner container, the lever member having an operation surface to be pressed, and the operation surface including an inclined surface sloped downward toward a side where an operator would face.

BRIEF DESCRIPTION OF THE DRAWINGS

FIGS. 1A to 1C are perspective views showing the external appearance of a printer according to one embodiment of the present invention, wherein FIG. 1A shows a state where a maintenance lid is closed, FIG. 1B shows a state where the maintenance lid is opened, and FIG. 1C shows a state where the maintenance lid is opened and a toner container is detached.

FIGS. 5A and 5B are sections showing one embodiment of a toner loading device, wherein FIG. 5A shows a state where a toner loading tube is set at a retracted position and FIG. 5B shows a state where the toner loading tube is set at a loading position.

FIGS. 8A to 8D are diagrams showing the function of a gear mechanism, wherein FIGS. 8A, 8B show a state where an operation knob of a first selector gear is set at such an open position as to open a shutter member and FIGS. 8C, 8D show a state where the operation knob is set at such a closed position as to close the shutter member.

DETAILED DESCRIPTION OF THE PREFERRED EMBODIMENTS

Hereinafter, one embodiment of the present invention is described in detail with reference to the accompanying drawings.

Figures 1A, 1B, 1C:
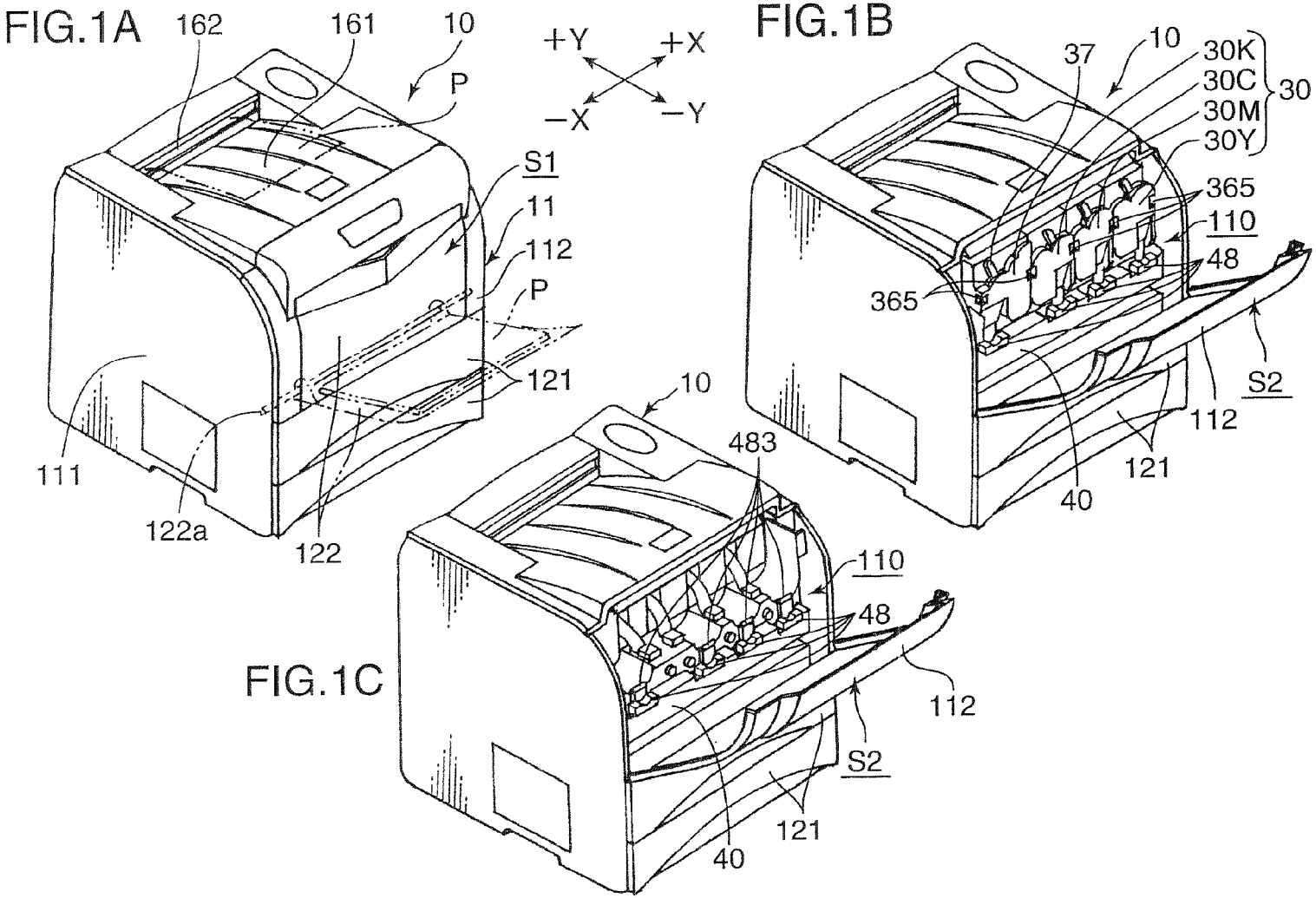

FIGS. 1A to 1C are perspective views showing the external appearance of a printer according to one embodiment of the present invention, wherein FIG. 1A shows a state where a maintenance lid is closed, FIG. 1B shows a state where the maintenance lid is opened, and FIG. 1C shows a state where the maintenance lid is opened and a toner container is detached. It should be noted that X-X directions and Y-Y directions are referred to as transverse directions and forward and backward directions, respectively, wherein −X direction is leftward direction, +X direction rightward direction, −Y direction forward direction and +Y direction backward direction.

As shown in FIGS. 1A to 1C, a printer 10 (image forming apparatus) is constructed such that color printing can be carried out and various devices to be described later are mounted in a printer main body 11 (apparatus main body) as a box having a substantially cubic shape in external appearance. The printer main body 11 has a rounded shape as a whole and is so designed as to give a visually soft and compact impression to users. In such a printer main body 11, a discharge tray 161 is arranged on the upper surface, a maintenance lid 112 is arranged on an upper part of the front surface to face a user, and detachably insertable sheet cassettes 121 are arranged below the maintenance lid 112. These make the printer main body 11 very easy to use.

The discharge tray 161 is for receiving a sheet P to which printing is applied, and forms an arcuate inclined surface sloped up toward the front end thereof so that the sheet P discharged through a discharge opening 162 formed at the rear side of the upper surface of the printer main body 11 and facing forward can be received.

The maintenance lid 112 is normally closed as shown in FIG. 1A, and is opened as shown in FIGS. 1B and 1C at the time of replacing a toner container 30 to be described in detail later. Such a maintenance lid 112 is rotatably supported about a supporting shaft 122*a* extending between front positions of a pair of side plates 111 of the printer main body 11 slightly above the sheet cassettes 121. The maintenance lid 112 is displaceable between a closing posture S1 to close a front opening 110 of the printer main body 11 (see FIG. 1A) and an opening posture S2 to open the front opening 110 of the printer main body 11 (see FIGS. 1B, 1C) by being rotated in forward and reverse directions about the supporting shaft 122*a*.

Such a maintenance lid 112 is provided with a manual inserting tray 122 rotatably supported about the supporting shaft 122*a*. This manual inserting tray 122 is used to manually supply a print sheet P to the printer 10. The manual inserting tray 122 is rotated in clockwise direction about the supporting shaft 122*a* with the maintenance lid 112 set in the closing posture S1 (shown by solid line in FIG. 1A), thereby being withdrawn from the maintenance lid 112 as shown by chain double-dashed line in FIG. 1A.

The toner containers 30 include four kinds of containers, i.e. a black container 30K filled with black toner particles, a cyan container 30C filled with cyan toner particles, a magenta container 30M filled with magenta toner particles, and a yellow container 30Y filled with yellow toner particles. The black container 30K, the cyan container 30C, the magenta container 30M and the yellow container 30Y are juxtaposed in this order from left to right while facing the front opening 110 in the printer main body 11.

The user faces the black to yellow containers 30K, 30C, 30M, 30Y as shown in FIG. 1B by opening the maintenance lid 112. If the black to yellow containers 30K, 30C, 30M, 30Y are detached from the printer main body 11 for the replacement, this results in a state shown in FIG. 1C.

The sheet cassettes 121 are for storing print sheets P, and are detachably mounted in the printer main body 11. Although two sheet cassettes 121 are provided at two levels in the example shown in FIGS. 1A to 1C, the number of the sheet cassettes 121 is not limited to two, and one, three or more sheet cassettes 121 may be provided at different levels.

Figure 2:
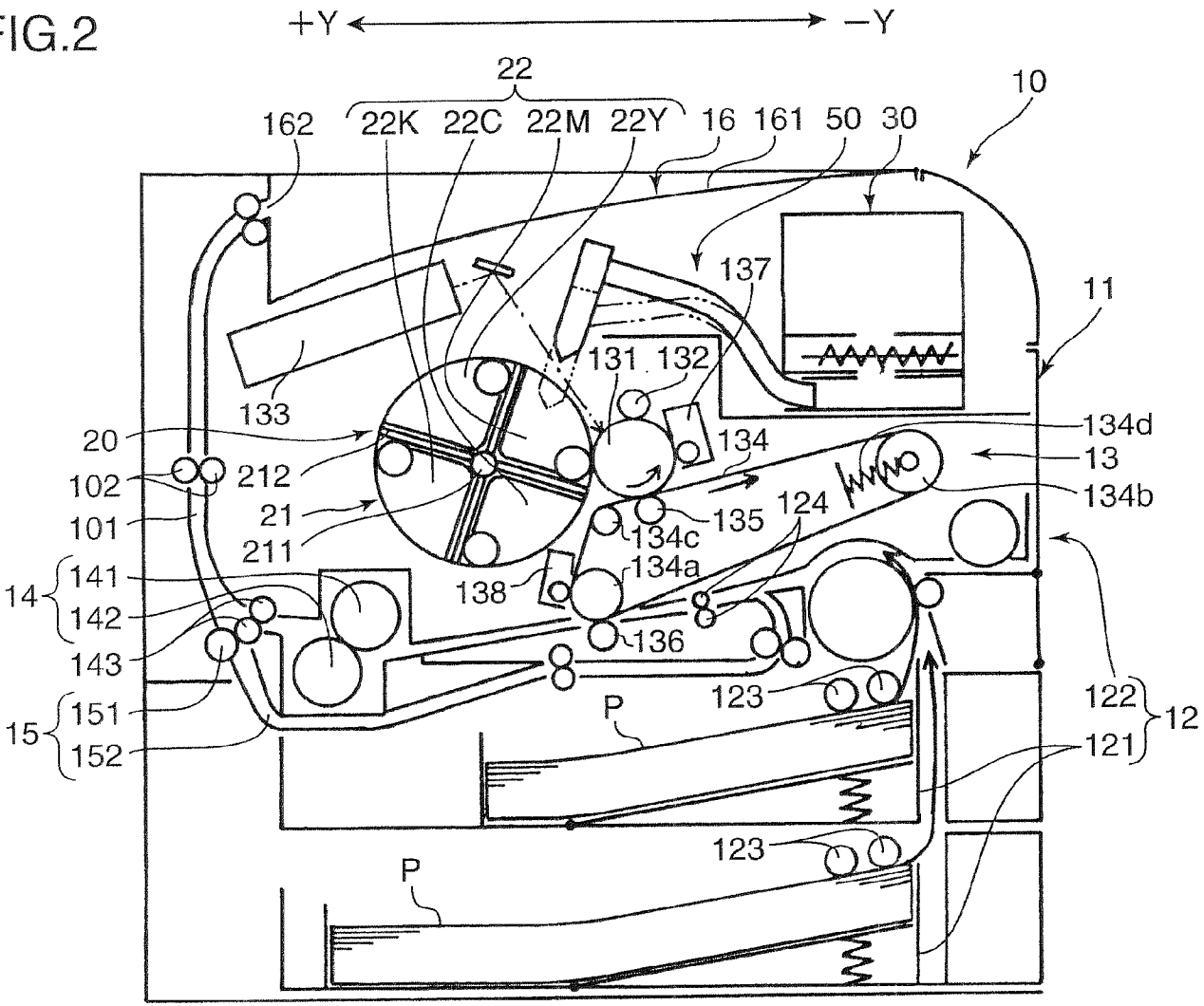
FIG. 2 is a side view in section showing one example of the internal construction of the printer.

FIG. 2 is a side view in section showing one embodiment of the internal construction of the printer 10. Directions indicated by Y in FIG. 2 are similar to the case of FIGS. 1A to 1C (Y are forward and backward directions (−Y: forward direction, +Y: backward direction)). As shown in FIG. 2, the printer 10 is constructed such that a sheet feeding unit 12 for feeding a sheet P to an image forming unit 13 to be described later, the image forming unit 13 for transferring a toner image to the sheet P while conveying the sheet P fed from the sheet feeding unit 12, a fixing unit 14 for fixing the transferred toner image to the sheet P, a discharge-end switching unit 15 for switching a discharge end of the sheet P having the toner image fixed thereto in the fixing unit 14, and a discharging unit 16 for discharging the sheet finished with printing are mounted in the printer main body 11.

The sheet feeding unit 12 includes the sheet cassettes 121 detachably mounted in a lower part of the printer main body 11 and capable of storing a plurality of sheets P, and the manual inserting tray 122 used to manually feed sheets P.

Pickup rollers 123 are disposed at a front upper position of each sheet cassette 121. The sheets P stored in each sheet cassettes 121 are picked up one by one by driving these pickup rollers 123 and fed toward the image forming unit 13.

The image forming unit 13 includes a photoconductive drum 131 which is rotatable about a central axis thereof extending in transverse direction (direction normal to the plane of FIG. 2) and on the outer circumferential surface of which an electrostatic latent image and then a toner image in conformity with this electrostatic latent image are formed, a charging roller 132 for producing uniform electric charges on the outer circumferential surface of the photoconductive drum 131 by charging this outer circumferential surface, an exposing device 133 for forming an electrostatic latent image on the outer circumferential surface of the photoconductive drum 131, to which the electric charges are uniformly given by the charging roller 132, by illuminating this outer circumferential surface with a laser beam based on image information, a rotary developing unit 20 for forming a toner image on the outer circumferential surface of the photoconductive drum 131 having the electrostatic latent image thereon by supplying toner particles to this outer circumferential surface, the toner containers 30 for supplying toner particles to the rotary developing unit 20, a transfer belt 134 to which the toner image formed on the outer circumferential surface of the photoconductive drum 131 is transferred, a primary transfer roller 135 for electrostatically peeling the toner image off the photoconductive drum 131 and transferring it to the outer surface of the transfer belt 134, a secondary transfer roller 136 for electrostatically peeling the toner image off the transfer belt 134 and transferring it to the conveyed sheet P fed from the sheet feeding unit 12, a drum cleaning device 137 for cleaning the outer circumferential surface of the photoconductive drum 131 after the transfer of the toner image to the transfer belt 134, and a belt cleaning device 138 for cleaning the outer surface of the transfer belt 134 after the transfer of the toner image to the sheet P.

Electric charges of a specified polarity are produced on the outer circumferential surface of the charging roller 132 by a high voltage applied from an unillustrated power supply. Uniform electric charges can be produced on the outer circumferential surface of the photoconductive drum 131 by holding the outer circumferential surface of such a charging roller 132 in contact with that of the photoconductive drum 131.

The exposing device 133 illuminates the outer circumferential surface of the photoconductive drum 131 uniformly charged by the charging roller 132 with a laser beam based on an image data inputted from an unillustrated computer or the like. An electrostatic latent image is formed on the outer circumferential surface of the photoconductive drum 131 through the illumination with this laser beam. Toner particles are supplied to such an electrostatic latent image from the rotary developing unit 20, thereby forming a toner image on the outer circumferential surface of the photoconductive drum 131, and this toner image is transferred to the turning transfer belt 134.

The rotary developing unit 20 includes a rotary frame 21 formed to have a circular shape in side view (view in a direction normal to the plane of FIG. 2), and four developing devices 22 mounted in the rotary frame 21 at even circumferential intervals. The rotary frame 21 is so supported at a position behind the photoconductive drum 131 as to be rotatable about a frame shaft 211 and parallel to the central axis of the photoconductive drum 131 substantially at the same height. Such a rotary frame 21 is circumferentially equally divided into four sections by four partition plates 212 projecting radially outward from the frame shaft 211, and the developing devices 22 are mounted in the respective sections.

There are four kinds of developing devices 22, i.e. a black developing device 22K filled with black toner particles, a cyan developing device 22C filled with cyan toner particles, a magenta developing device 22M filled with magenta toner particles and a yellow developing device 22Y filled with yellow toner particles. For example, when a toner image is formed with the yellow toner particles on the outer circumferential surface of the photoconductive drum 131, the yellow developing device 22Y is set at a position facing the photoconductive drum 131 by the rotation of the rotary frame 21 about the frame shaft 211, and the yellow toner image is formed on the outer circumferential surface of the photoconductive drum 131 by the photoconductive drum 131 making one turn. This yellow toner image is immediately transferred to the turning transfer belt 134.

The formation of magenta, cyan and black toner images on the outer circumferential surface of the photoconductive drum 131 is similar to that of the yellow toner image. The developing device 22 filled with toner particles of the corresponding color is caused to face the outer circumferential surface of the photoconductive drum 131, whereby the toner images of the next colors are successively transferred to the outer circumferential surface of the photoconductive drum 131 from which the toner image disappeared by being transferred to the transfer belt 134. A color image is formed on the outer surface of the transfer belt 134 by properly synchronizing a turning movement of the transfer belt 134 and toner forming movements of the photoconductive drum 131. This color image is transferred to the sheet P fed from the sheet feeding unit 12 by the action of the secondary transfer roller 136, whereby the sheet P is color printed.

It should be noted that a pair of registration rollers 124 are disposed at a position immediately upstream of the secondary transfer roller 136, and a conveyance timing of the sheet P fed to the image forming unit 13 from the sheet feeding unit 12 is adjusted by this pair of registration rollers 124. The color image on the transfer belt 134 is transferred to a proper position on the sheet P by the adjustment of the conveyance timing by the registration rollers 124.

Figure 3:
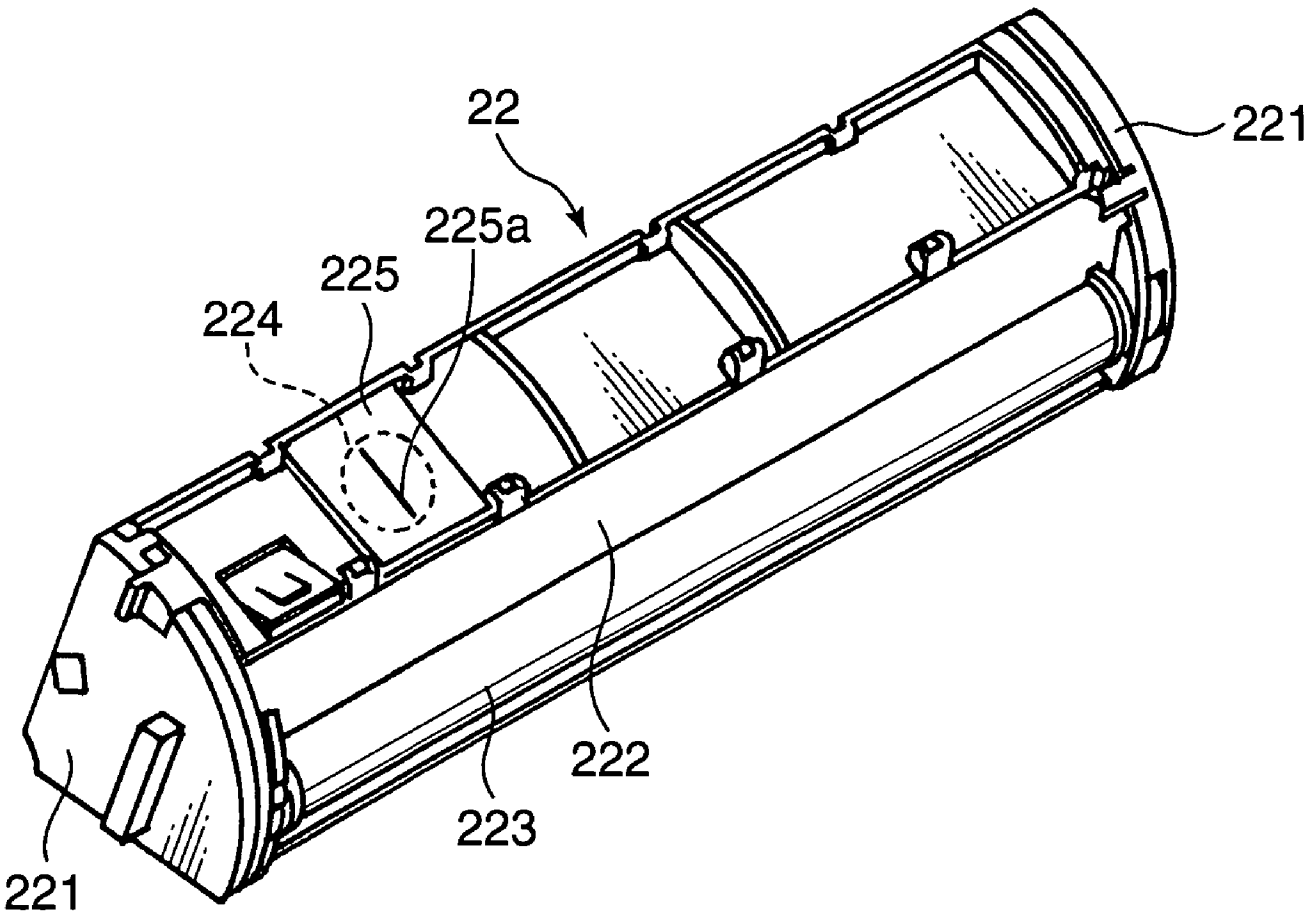
FIG. 3 is a perspective view showing one embodiment of a developing device.

FIG. 3 is a perspective view showing one embodiment of the developing device 22. As shown in FIG. 3, the developing device 22 has a pair of fan-shaped side plates 221 whose center angle is set at 90° in side view, a toner storing container 222 tightly held between the fan-shaped side plates 221, and a development sleeve 223 extending between the fan-shaped side plates 221 while being adjacent to the toner storing container 222. A toner introduction opening 224 for introducing toner particles into the developing device 22 is formed at a specified position of the toner storing container 222, and a sheet-shaped lid 225 made of an elastic material such as rubber and adapted to close the toner introduction opening 224 is provided by adhesion or other method. A slit 225*a* into which the leading end of a toner transferring pipe 51 to be described later is inserted is formed at a substantially middle position of the sheet-shaped lid 225.

Toner particles are loaded from the toner container 30 into the toner storing container 222 by inserting a toner loading tube 53 (see FIGS. 5A, 5B) of the toner transferring pipe 51 into the slit 225*a*. An unillustrated agitating member having an agitating fin and the like is provided in the toner storing container 222, and toner particles supplied into the toner storing container 222 is imparted to the outer circumferential surface of the development sleeve 223 while being uniformly dispersed by the agitation of this agitating member and is successively supplied to the outer circumferential surface of the photoconductive drum 131.

Referring back to FIG. 2, the transfer belt 134 is mounted on the primary transfer roller 135, an idle roller 134*c* disposed at a position slightly behind the primary transfer roller 135, a drive roller 134*a* disposed at a position below and slightly behind the photoconductive drum 131 and drivingly rotated by an unillustrated drive motor, and a driven roller 134*b* opposed to the drive roller 134*a* at a position below and before the photoconductive drum 131. The driven roller 134*b* is biased in a direction away from the drive roller 134*a* by a biasing force of a biasing member 134*d* such as a coil spring, whereby the transfer belt 134 is kept tense. At a position right below the drive roller 134*a*, the secondary transfer roller 136 is opposed to the drive roller 134*a* with the transfer belt 134 held therebetween.

A bias voltage for electrostatically peeling the toner image off the transfer belt 134 is applied to the secondary transfer roller 136 from an unillustrated power supply. Accordingly, the toner image on the transfer belt 134 is transferred to the sheet P passing between the transfer belt 134 and the secondary transfer roller 136.

The belt cleaning device 138 for cleaning the outer surface of the transfer belt 134 after the transfer of the toner image to the sheet P is disposed between the drive roller 134*a* and the idle roller 134*c*. The transfer belt 134 cleaned by the belt cleaning device 138 moves toward the photoconductive drum 131 to receive the next image transfer operation.

The fixing unit 14 is for fixing the toner image transferred to the sheet P in the image forming unit 13 to the sheet P and includes a fixing roller 141 heated by an electrical heating element, and a pressure roller 142 which is opposed to the fixing roller 141 from below and whose outer circumferential surface is pressed into contact with the outer circumferential surface of the fixing roller 141. The sheet P having the toner image transferred thereto by the transfer belt 134 in the image forming unit 13 is introduced to the fixing unit 14 while being guided by the turning movement of the transfer belt 134 and being tightly held between the transfer belt 134 and the second transfer roller 136. The toner image is fixed to the sheet P by the heat given upon passing between the fixing roller 141 and the pressure roller 142. The sheet P after the fixing operation is led to a discharge conveyance path 101 by driving a pair of first discharge rollers 143, moved upward in the discharge conveyance path 101 by successively driving a pair of second discharge rollers 102, and is discharged onto the discharge tray 161 provided at the top of the printer main body 11 through the discharge opening 162.

The discharge-end switching unit 15 is used in the case of applying duplex printing to the sheet P. The discharge-end switching unit 15 sends the sheet P fed from the fixing unit 14 to the discharge conveyance path 101 after the image fixing operation on one surface being completed, and thereafter sends back the sheet P to the image forming unit 13 while being turned upside down. Such a discharge-end switching unit 15 includes a return roller 151 arranged at the bottom end of the discharge conveyance path 101 such that the outer circumferential surface thereof is held in contact with that of the lower first discharge roller 143, and a return conveyance path 152 extending from a position right below the return roller 151 toward a side upstream of the registration rollers 124 (toward the right side in FIG. 2) while passing below the fixing unit 14.

Upon applying duplex printing to the sheet P, the sheet P finished with the one-side printing after the image fixing operation is led to the discharge conveyance path 101 until the trailing end thereof passes the pair of discharge rollers 143 and, then, the pair of second discharge rollers 102 are driven in reverse direction. In this way, the sheet P through with the one-side printing is returned back to the return conveyance path 152 by being guided by the driving of the return roller 151, and moves toward the pair of registration rollers 124 in the return conveyance path 152 while being turned upside down. Thereafter, printing is applied to the rear surface of the sheet P in the image forming unit 13.

The toner containers 30 are for storing toner particles of the respective colors to replenish the black developing device 22K, the cyan developing device 22C, the magenta developing device 22M and the yellow developing device 22Y (see FIG. 1B) of the rotary developing unit 20 with toner particles of the corresponding colors. Four toner containers 30 are used in correspondence with the black to yellow developing devices 22K, 22C, 22M and 22Y. These four toner containers 30 are detachably mounted on a platform 40 extending in transverse direction at a substantially middle-level position of the front side of the printer main body 11 as shown in FIGS. 1B and 1C. A toner transferring mechanism 50 for supplying toner particles in the toner containers 30 to the respective developing devices 22 is provided between the respective toner containers 30 and the rotary developing unit 20.

Figure 4:
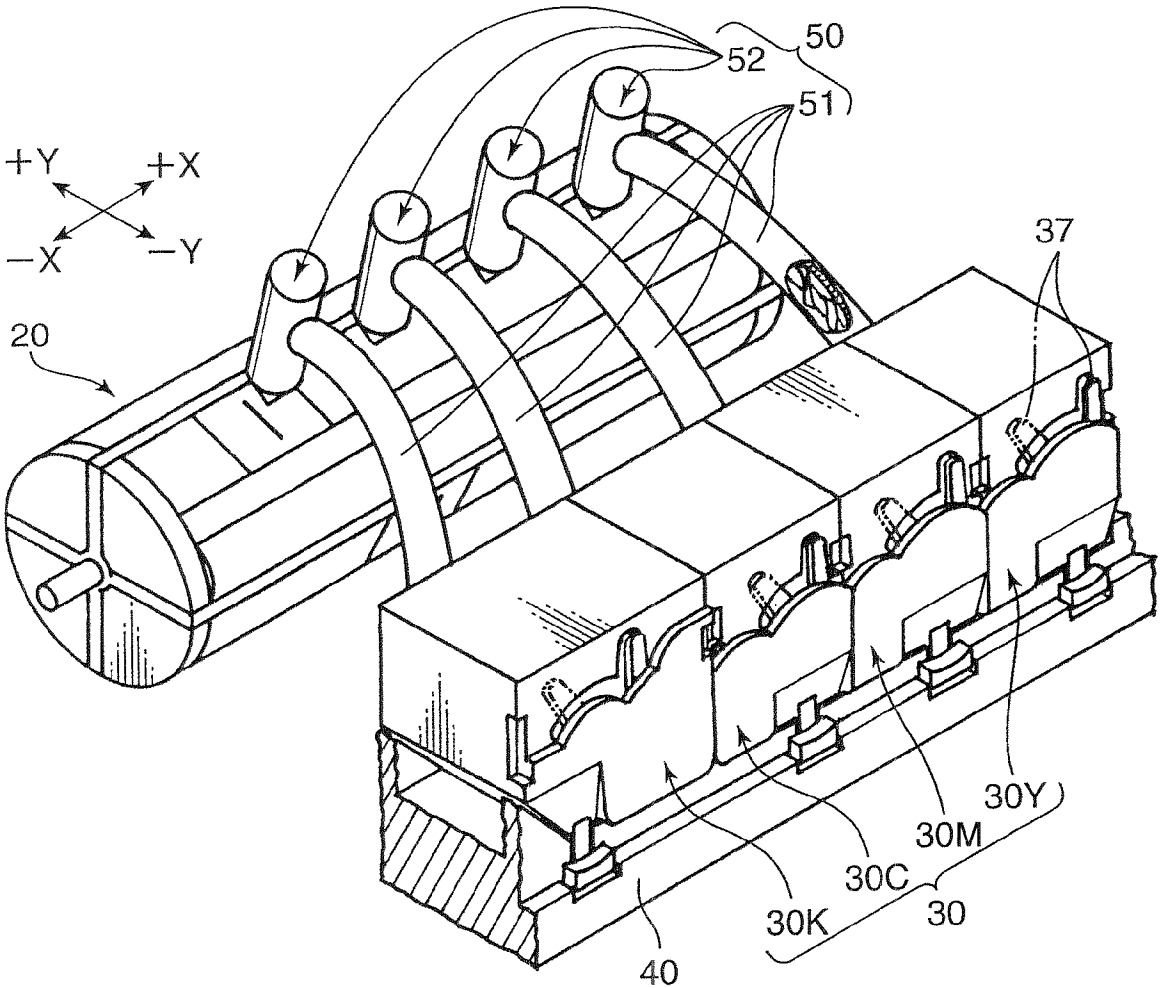
FIG. 4 is a schematic perspective view showing a relative positional relationship of a rotary developing device, a toner container, a platform and a toner transferring mechanism.

FIG. 4 is a schematic perspective view showing a relative positional relationship of the rotary developing unit 20, the toner containers 30, the platform 40 and the toner transferring mechanism 50. It should be noted that directions indicated by X and Y in FIG. 4 are similar to the case of FIGS. 1A to 1C (X are transverse directions (−X: leftward direction, +X: rightward direction) and Y are forward and backward directions (−Y: forward direction, +Y: backward direction)).

As shown in FIG. 4, the black container 30K, the cyan container 30C, the magenta container 30M and the yellow container 30Y are mounted on the platform 40 side by side in this order from left to right.

The toner transferring mechanism 50 includes four toner transferring pipes 51 whose upper ends (front ends) are connected with the black to yellow containers 30K, 30C, 30M and 30Y via the platform 40, and four toner loading devices 52 connected with the downstream end (rear ends) of the respective toner transferring pipes 51.

The toner transferring pipes 51 are made of a flexible material such as rubber or soft synthetic resin and can follow specified movements of the toner loading devices 52 by undergoing elastic deformations. A spiral feeder 511 made of a coil spring that can be driven to rotate about a central axis thereof by specified driving means is mounted in each toner transferring pipe 51. Toner particles extracted from the toner container 30 moves in the toner transferring pipe 51 by the rotation of the spiral feeder 511 about the central axis in a specified direction, and is loaded into the developing device 22 via the toner loading device 52.

Four toner loading devices 52 are so juxtaposed in transverse direction as to correspond to the sheet-shaped lids 225 of the respective black to yellow developing devices 22K, 22C, 22M and 22Y at positions above the rotary developing unit 20. Toner particles transferred in the toner transferring pipes 51 are supplied into the developing devices 22 via the toner loading devices 52 with parts of the toner loading devices 52 located in the developing devices 22 through the slits 225*a* of the sheet-shaped lids 225.

Figure 5A:
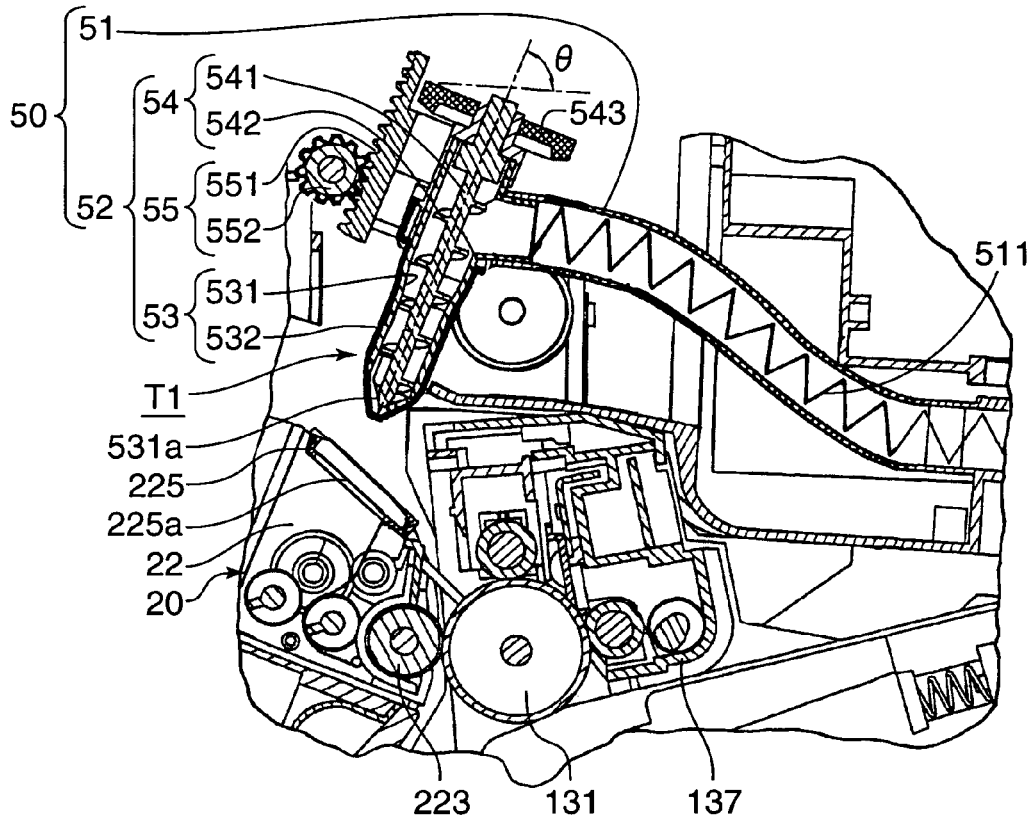
Figure 5B:
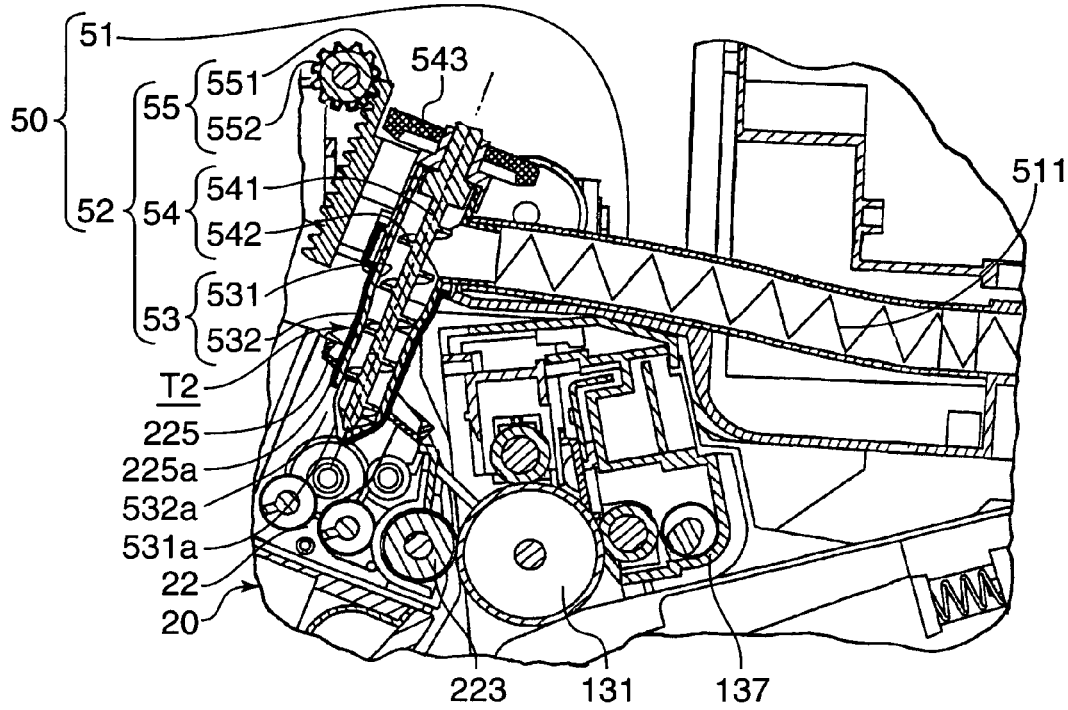

FIGS. 5A and 5B are sections showing one embodiment of the toner loading device 52, wherein FIG. 5A shows a state where the toner loading tube 53 is set at a retracted position T1 and FIG. 5B shows a state where the toner loading tube 53 is located at a loading position T2. The toner loading device 52 is comprised of the toner loading tube 53 connected with the downstream end of the corresponding toner transferring pipe 51, a screw feeder 54 concentric with the toner loading tube 53 and driven to rotate about a central axis thereof by unillustrated driving means mounted in the toner loading tube 53, and an elevating mechanism 55 for moving the toner loading tube 53 upward and downward between the retracted position T1 (see FIG. 5A) where the toner loading tube 53 is distanced upward from the developing device 22 and the loading position T2 (see FIG. 5B) where the toner loading tube 53 is located in the developing device 22.

Each toner loading tube 53 has a double structure comprised of an inner tube body 531 and an outer tube body 532 fitted on the inner tube body 531 while being held in sliding contact therewith. The downstream end of the toner transferring pipe 51 is connected with the inner tube body 531. The outer tube body 532 is rotatable in forward and reverse directions around the inner tube body 531 within a specified range without interfering with the toner transferring pipe 51.

The bottom ends of the inner tube body 531 and the outer tube body 532 are both tapered into conical shapes. Openings are formed in these conical portions (inner tube opening 531*a* formed in the inner tube body 531, outer tube opening 532*a* formed in the outer tube body 532). Toner particles fed into the toner loading tube 53 comes out through the respective openings 531*a*, 532*a* while the respective openings 531*a* 532*a* overlap each other (i.e. a state shown in FIG. 5B where a shutter is open). On the other hand, the outer tube body 532 rotates about the inner tube body 531 by a specified angle in this state, whereby the wall surface of the outer tube body 532 closes the inner tube opening 531*a* (i.e. a state shown in FIG. 5A where the shutter is closed) to prevent the leakage of toner particles. Such a rotational movement of the outer tube body 532 is interlocked with upward and downward movements of the toner loading tube 53 by the elevating mechanism 55.

In a state where the toner loading tube 53 is set at the retracted position T1, the bottom end of the toner loading tube 53 is distanced from the sheet-shaped lid 225 of the developing device 22 with the inner tube opening 531*a* closed by the outer tube body 532 as shown in FIG. 5A. Contrary to this, in a state where the toner loading tube 53 is set at the loading position T2, the bottom end of the toner loading tube 53 is located in the developing device 22 through the slit 225*a* of the sheet-shaped lid 225 with the inner tube opening 531*a* caused to overlap the outer tube opening 532*a* and, thereby, exposed.

Accordingly, the leakage of toner particles in the toner loading tube 53 through the inner tube opening 531*a* is prevented with the toner loading tube 53 set at the retracted position T1, whereas toner particles in the toner loading tube 53 are supplied into the developing device 22 through the inner tube opening 531*a* and the outer tube opening 532*a* with the toner loading tube 53 set at the loading position T2.

In this embodiment, an angle θ between a direction of the central axis of the toner loading tube 53 and a horizontal line is set larger than an angle of repose of toner particles, thereby preventing toner particles introduced into the toner loading tube 53 from clogging in the toner loading tube 53. Specifically, the angle of repose of toner particles is about 40° and the angle θ is set at about 70°.

The screw feeder 54 is comprised of a screw shaft 541 concentric with the central axis of the toner loading tube 53 and a screw fin 542 integrally formed on the outer circumferential surface of the screw shaft 541 and concentric with the screw shaft 541. The upper end of the screw shaft 541 projects out from the toner loading tube 53 and a screw gear 543 is concentrically fixed to this projecting portion. This screw gear 543 is rotated about a central axis thereof by unillustrated driving means, thereby integrally rotating the screw fin 542 about the screw shaft 541. Thus, toner particles fed from the toner transferring pipe 51 is forcibly moved downward.

The elevating mechanism 55 is for moving the toner loading tube 53 upward and downward relative to the developing device 22. Such an elevating mechanism 55 is provided with a rack 551, a pinion 552 in mesh with the rack 551, and an unillustrated drive motor for giving a driving force to the pinion 552 via a specified intermediate gear.

The rack 551 is fixed to an upper left part of the outer circumferential surface of the inner tube body 531 in FIG. 5A and is so mounted as to project leftward from the inner tube body 531. On the other hand, a window is formed in a part of the outer tube body 532 corresponding to the rack 551, which is exposed to the outside through this window. A dimension of the window in circumferential direction is set to be longer than the width (dimension in circumferential direction) of the rack 551, whereby the window is rotatable about the central axis of the outer tube body 532 relative to the rack 551 (i.e. relative to the inner tube body 531) within a specified range. The outer tube body 532 is made rotatable in forward and backward directions about the inner tube body 531 in order to open and close the inner tube opening 531*a* of the inner tube body 531.

An unillustrated guidable projection is provided at a specified position of the outer tube body 532. On the other hand, an unillustrated cylindrical cam member surrounding the outer tube body 532 is provided outside the outer tube body 532. A spiral cam groove into which the guidable projection is fitted while being held in sliding contact is formed in the inner circumferential surface of this cylindrical cam member. If the inner tube body 531 is moved upward and downward via the specified intermediate gear, the pinion 552 and the rack 551 by driving the drive motor, the outer tube body 532 is also moved upward and downward (i.e. the toner loading tube 53 is moved upward and downward). As the toner loading tube 53 moves upward and downward, the guidable projection provided on the outer tube body 532 is guided by the spiral cam groove of the cam member, whereby the outer tube body 532 rotates in forward and reverse directions about the central axis thereof.

The spiral cam groove formed in the inner circumferential surface of the cam member is shaped such that the outer tube body 532 can close and open the inner tube opening 531*a* of the inner tube body 531 as the toner loading tube 53 moves downward and upward.

In this embodiment, the inner tube opening 531*a* of the inner tube body 531 is closed by the outer tube body 532 by the rotation of the outer tube body 532 in a specified direction upon setting the toner loading tube 53 at the retracted position T1. On the other hand, the inner tube opening 531*a* of the inner tube body 531 overlaps the outer tube opening 532*a* of the outer tube body 532 to be opened by the rotation of the outer tube body 532 in a reverse direction upon setting the toner loading tube 53 at the loading position T2.

Figure 6:
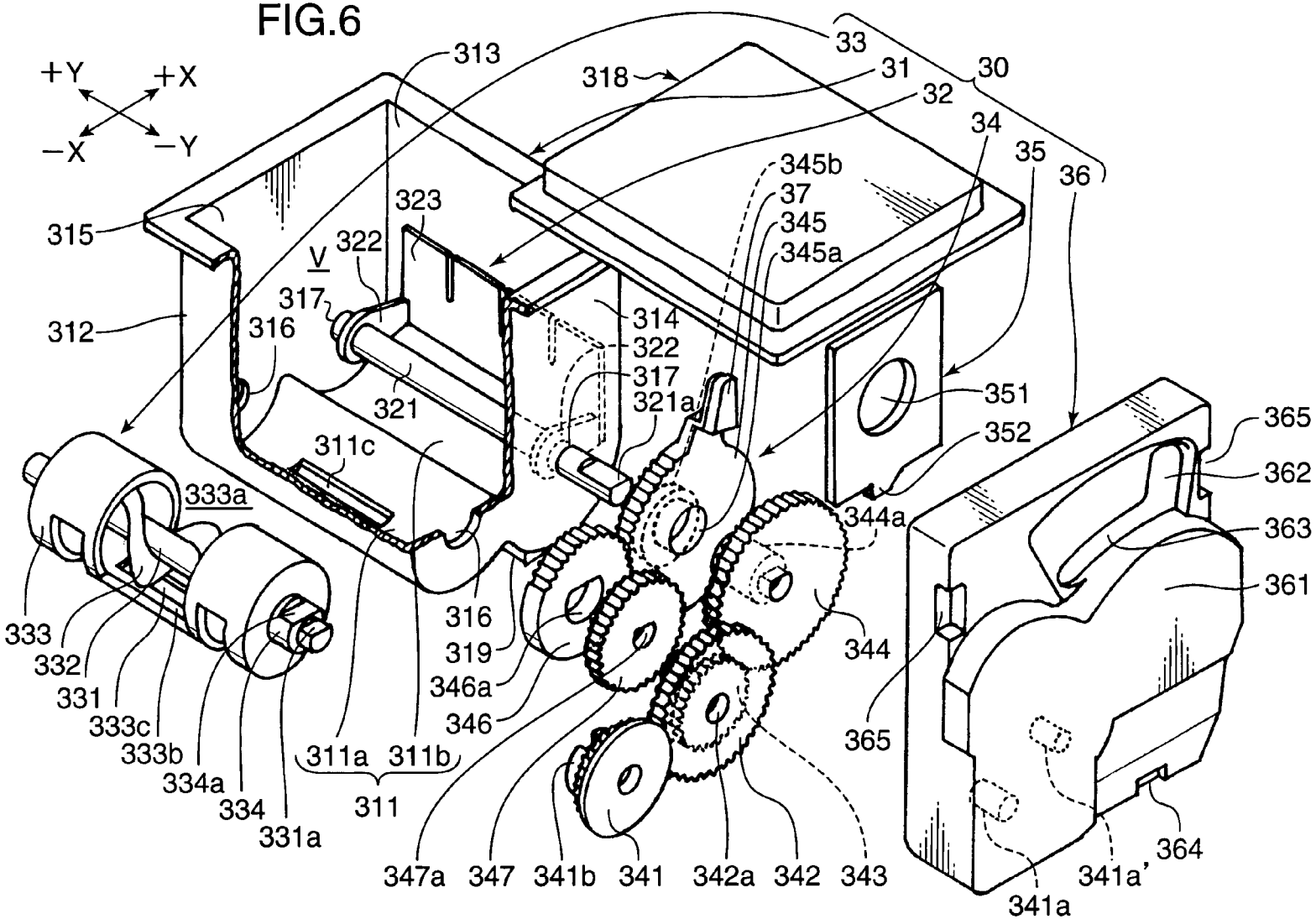
FIG. 6 is an exploded perspective view partly cut away showing one embodiment of a toner container.
Figure 7:
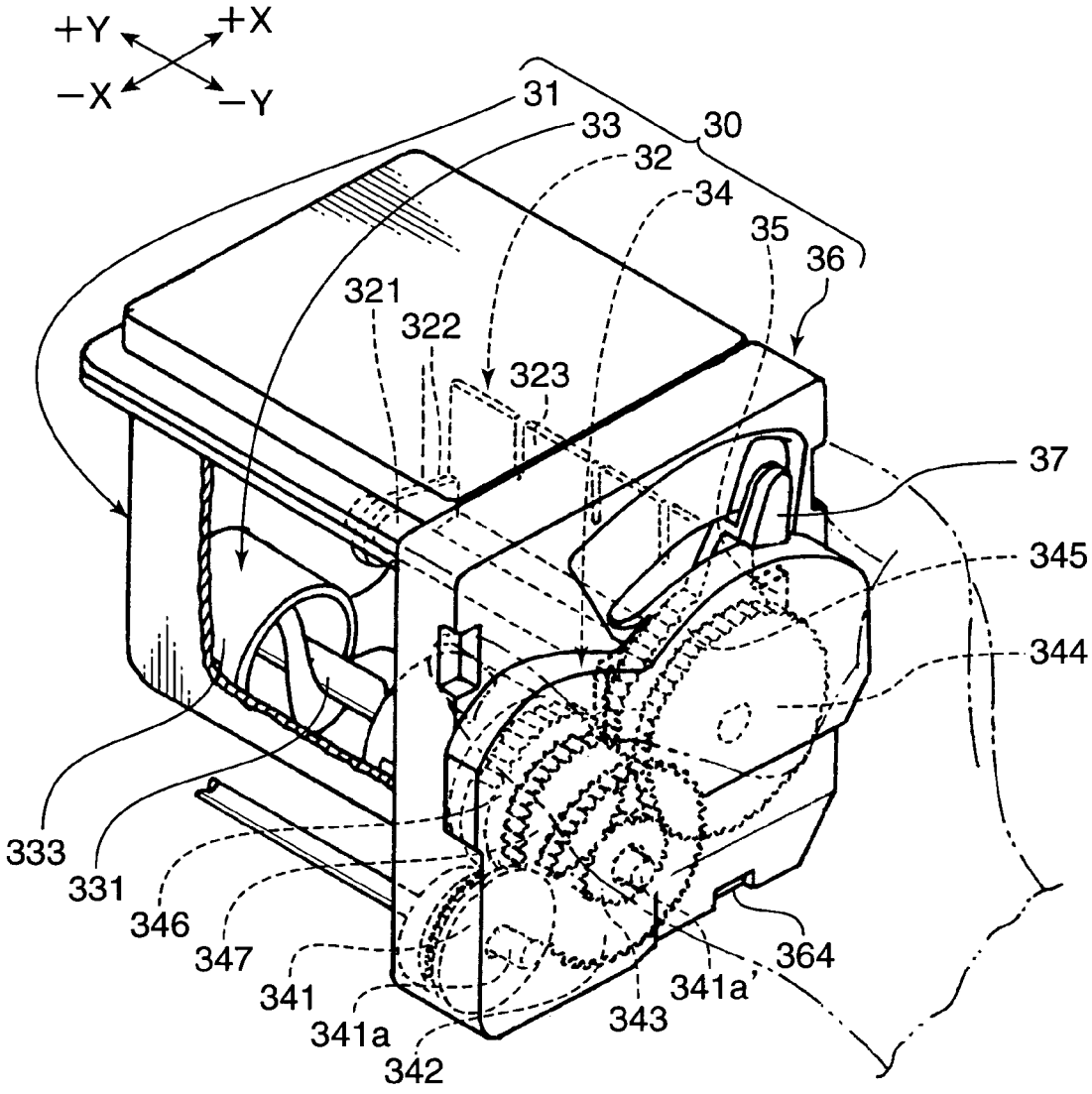
FIG. 7 is a perspective view partly cut away showing the assembled toner container.

Hereinafter, the toner containers 30 detachably mounted at positions (see FIG. 1C) in the front opening 110 of the printer main body 11 are described in detail. FIG. 6 is an exploded perspective view partly cut away showing one embodiment of the toner container 30, and FIG. 7 is a perspective view partly cut away showing the assembled toner container 30. In FIGS. 6 and 7, any one of the cyan to yellow containers 30*c*, 30M, 30Y of the four toner containers 30 is shown as an example. The back container 30K has a larger capacity than the others, but has a basic construction similar to those of the cyan to yellow containers 30C, 30M, 30Y. Directions indicated by X and Y in FIGS. 6 and 7 are similar to the case of FIG. 1 (X are transverse directions (−X: leftward direction, +X: rightward direction) and Y are forward and backward directions (−Y: forward direction, +Y: backward direction)).

First, as shown in FIG. 6, the toner container 30 is provided with a container case 31 to be filled with toner particles and having a substantially rectangular parallelepipedic shape, an agitating member 32 mounted in the container case 31 for agitating toner particles inside, a shutter member 33 mounted in the container case 31 for performing opening and closing operations and dispensing toner particles inside to the toner transferring pipe 51 (see FIGS. 5A, 5B), a gear mechanism 34 for causing the agitating member 32 and the shutter member 33 to agitate toner particles and dispense toner particles, respectively, and causing the shutter member 33 to perform the opening and closing operations, and a lock plate 35 for locking the mounted state of the toner container 30 in the printer main body 11, and a front lid 36 to be mounted on the container case 31 to cover the front surface thereof.

The container case 31 includes a bottom plate 311, a left side plate 312 standing from the left edge of the bottom plate 311, a right side plate 313 standing from the right edge of the bottom plate 311, a front plate 314 standing from the front edge of the bottom plate 311, and a rear plate 315 standing from the rear edge of the bottom plate 311. A space surrounded by there bottom plate 311, left side plate 312, right side plate 313, front plate 314 and rear plate 315 serves as a toner storage space V for storing toner particles.

The bottom plate 311 is comprised of a smaller arcuate bottom plate 311*a* formed at the left side of the bottom plate 311 and having a small arcuate shape in front view, and a larger arcuate bottom plate 311*b* formed at the right side of the bottom plate 311 and having a larger arcuate shape in front view than the smaller arcuate bottom plate 311*a*. The bottommost position of the smaller arcuate bottom plate 311*a* is set to be slightly above that of the larger arcuate bottom plate 311*b*. A discharge opening 311*c* in the form of an oblong hole long in forward and backward directions is formed substantially in the middle in forward and backward directions at the bottommost position of such a smaller arcuate bottom plate 311*a*.

Shutter-member mount holes 316 used to mount the shutter member 33 are formed in the front and rear plates 314, 315 at positions corresponding to the center of curvature of the smaller arcuate bottom plate 311*a*. Further, agitating-member mount holes 317 used to mount the agitating member 32 are formed in the front and rear plates 314, 315 at positions corresponding to the center of curvature of the larger arcuate bottom plate 311*b*. The gear mechanism 34 is mounted on the outer surface of the front plate 314 and linked with the shutter member 33 and the agitating member 32 via the shutter-member mount hole 316 and the agitating-member mount hole 317.

An upper opening of such a container case 31 is integrally closed by an upper lid 318 after a specified amount of toner particles are loaded into the toner storage space V. The gear mechanism 34 is covered by the front lid 36 mounted on the front plate 314 of the container case 31 to be protected.

The agitating member 32 has an agitating shaft 321 rotatably fittable into the pair of agitating-member mount holes 317 of the container case 31 about a central axis thereof, a pair of front and rear agitating arms 322 projecting in radial direction from the opposite sides of the agitating shaft 321 in the toner storage space V, and an agitating sheet 323 mounted between the leading ends of the agitating arms 322. The leading end of a portion of the agitating shaft 321 projecting out from the front plate 314 has the outer circumferential surface thereof partly cut flat, thereby forming a D-cut surface 321*a*.

The length of the agitating arms 322 from the central axis of the agitating shaft 321 to the tips thereof is set to be slightly shorter than an inner radius of curvature of the larger arcuate bottom plate 311*b*, so that the agitating arms 322 are integrally rotatable about the agitating shaft 321 in the toner storage space V. The agitating sheet 323 is made of a flexible material and so arranged as to extend in a direction (counterclockwise direction when viewed from front in the example shown in FIG. 6) normal to the agitating arms 322.

Accordingly, by rotating the agitating shaft 321 in clockwise direction about its central axis, the agitating sheet 323 is rotated about the agitating shaft 321 while the leading end edge thereof is held in sliding contact with the right side plate 313 and the larger arcuate bottom plate 311*b*, whereby toner particles stored in the toner storage space V of the container case 31 is agitated.

The shutter member 33 includes a shutter shaft 331 to be fitted in a pair of shutter-member mount holes 316 of the container case 31, a spiral fin 332 concentrically and integrally rotatably fitted on the shutter shaft 331, and a shutter cylinder 333 relatively rotatably fitted on a portion of the shutter shaft 331 located in the container case 31 while surrounding the spiral fin 332.

The outer diameter of the shutter cylinder 333 is set slightly shorter than the inner radius of curvature of the smaller arcuate bottom plate 311*a*, whereby the shutter cylinder 333 is relatively rotatable about the shutter shaft 331 while being held in sliding contact with the smaller arcuate bottom plate 311*a*. An introducing opening 333*a* for introducing toner particles in the storage space V into the shutter cylinder 333 is formed at a middle position of such a shutter cylinder 333 with respect to forward and backward directions while circumferentially extending over a specified angle (larger than about 180° in this embodiment), and an arcuate shutter plate 333*b* capable of closing the discharge opening 311*c* is formed on the same circumferential surface of the shutter cylinder 333 as the introducing opening 333*a*. This arcuate shutter plate 333*b* is formed with an oblong hole 333*c* extending in forward and backward directions.

The discharge of toner particles stored in the toner storage space V is hindered by closing the discharge opening 311*c* by means of the arcuate shutter plate 333*b*. On the other hand, toner particles in the container case 31 is discharged into the toner transferring pipe 51 through the oblong hole 333*c* and the discharge opening 311*c* via the shutter member 33 when the oblong hole 333*c* overlaps the discharge opening 311*c*.

The shutter cylinder 333 is provided with a bush 334 concentrically projecting forward from the front end thereof and fitted on the shutter shaft 331 while being held in sliding contact therewith. The shutter member 33 is mounted in the container case 31 with the bush 334 fitted in and held in sliding contact with the shutter-member mount hole 316. A driving force from the gear mechanism 34 is transmitted to the bush 334 to enable the shutter cylinder 333 to rotate about the shutter shaft 331. Such a bush 334 is formed with a D-cut surface 334*a*, and the front end of the shutter shaft 331 is also formed with a D-cut surface 331*a*. The respective D-cut surfaces 331*a*, 334*a* are for independently transmitting the driving force from the gear mechanism 34 to the shutter shaft 331 and the shutter cylinder 333, respectively.

The gear mechanism 34 includes a drive gear 341 to which a driving force from a specified drive motor in the printer main body 11 is transmitted, a first driven gear 342 in mesh with the drive gear 341, a second driven gear 343 concentrically and integrally rotatably fixed to the rear surface of the first driven gear 342, a third driven gear 344 in mesh with the second driven gear 343, a first selector gear 345 concentric with and rotatable relative to the third driven gear 344, a second selector gear 346 concentric with and rotatable relative to the second driven gear 343 while being held in mesh with the first selector gear 345, and a fourth driven gear 347 concentric with the second selector gear 346 and in mesh with the second driven gear 343.

The drive gear 341 is so supported on a projecting shaft 341*a* as to be rotatable about this projecting shaft 341*a* projecting forward at a position of the inner surface (rear surface) of the front lid 36 distanced to the lower left side from the front plate 314 of the container case 31. A connecting projection 341*b* projects from the rear surface of such a drive gear 341, and a driving force from the unillustrated driving means in the printer main body 11 is transmitted to the drive gear 341 via this connecting projection 341*b*.

Coupling holes 342*a* used to fit the first and second driven gears 342, 343 on a second projecting shaft 341*a*' of the front lid 36 are formed at the center positions of the first and second driven gears 342, 343. The second driven gear 343 is in mesh with both the third driven gear 344 and the fourth driven gear 347 while being fitted on the second projecting shaft 341*a*'. The second driven gear 343 is rotated about the second projecting shaft 341*a*', thereby simultaneously rotating the third and fourth driven gears 344 and 347 in the same direction.

The third driven gear 344 has a shaft tube 344*a* concentrically projecting backward from a center position thereof. The inner hole of the shaft tube 344*a* has a diameter set slightly larger than the diameter of the agitating shaft 321 and is D-shaped in front view so as to correspond to the D-cut surface 321*a* of the agitating shaft 321. Accordingly, the agitating shaft 321 integrally rotates with the third driven gear 344 by fitting the shaft tube 344*a* on the agitating shaft 321.

The first selector gear 345 is for causing the shutter cylinder 333 of the shutter member 33 to open and close via the second selector gear 346. Such a first selector gear 345 has gear teeth formed on an end surface thereof facing the second selector gear 346 in a specified angle range, and has an operation knob 37 projecting substantially upward from the circumferential surface thereof where no gear teeth are formed. This operation knob 37 projects more forward than the front surface of the first selector gear 345 and penetrates the front lid 36 to be located at the front side of the front lid 36.

A fitting hole 345*a* to be fitted on the shaft tube 344*a* of the third driven gear 344 while being held in sliding contact therewith is formed at a center position of the first selector gear 345. Thus, the first selector gear 345 is rotatable in forward and reverse directions about the shaft tube 344*a* by operating the operation knob 37.

A round cam 345*b* formed with a hole concentric with and having the same diameter as the fitting hole 345*a* is provided on the rear surface (back surface) of the first selector gear 345. This round cam 345*b* is for operating the lock plate 35, and the phase thereof is set such that a degree of eccentricity in downward direction is maximum with the operation know 37 located at a rightmost position.

The second selector gear 346 is formed on its peripheral surface with gear teeth corresponding to those of the first selector gear 345, and is rotated in opposite directions as the first selector gear 345 is rotated in forward and reverse directions by operating the operation knob 37. A fitting hole 346*a* to be fitted on the bush 334 of the shutter cylinder 333 is formed at a center position of the second selector gear 346. This fitting hole 346*a* is D-shaped in front view so as to correspond to the D-cut surface 334*a* of the bush 334. The shutter cylinder 333 integrally rotates with the second selector gear 346 by engaging the fitting hole 346*a* with the bush 334.

Accordingly, by rotating the first selector gear 345 in forward and reverse directions about the shaft tube 344*a* through the operation of the operation knob 37, this rotation is transmitted to the shutter cylinder 333 via the second selector gear 346, whereby the arcuate shutter plate 333*b* of the shutter cylinder 333 closes and opens the discharge opening 311*c*. In this embodiment, the arcuate shutter plate 333*b* closes the discharge opening 311*c* with the operation knob 37 operated to the rightmost end while opening the discharge opening 311*c* with the operation knob 37 operated to the leftmost end.

A fitting hole 347*a* to be fitted on the shutter shaft 331 of the shutter member 33 is formed at a center position of the fourth driven gear 347. This fitting hole 347*a* is D-shaped in front view so as to correspond to the D-cut surface 331*a* of the shutter shaft 331. The shutter shaft 331 integrally rotates with the fourth driven gear 347 by engaging the fitting hole 347*a* with the front end of the shutter shaft 331.

Accordingly, the driven rotation of the drive gear 341 is transmitted to the shutter shaft 331 via the first driven gear 342, the second driven gear 343 and the fourth driven gear 347, and toner particles in the shutter cylinder 333 is moved by the integral rotation of the spiral fin 333 about the shutter shaft 331. Further, toner particles in the shutter cylinder 333 is easily discharged to the outside through the oblong hole 333*c* and the discharge opening 311*c*.

The lock plate 35 is for retaining the toner container 30 in the printer main body 11 with the toner container 30 mounted in the printer main body 11 and the shutter member 33 opened by operating the operation knob 37. The lock plate 35 is tightly held between the first selector gear 345 and the front plate 314 of the container case 31. The lock plate 35 is formed by a rectangular flat plate, and is formed in the center with a guidable hole 351 to be fitted on the round cam 345*b* of the first selector gear 345, and at a middle position of the bottom end thereof with a locking projection 352 projecting downward.

Figure 8A:
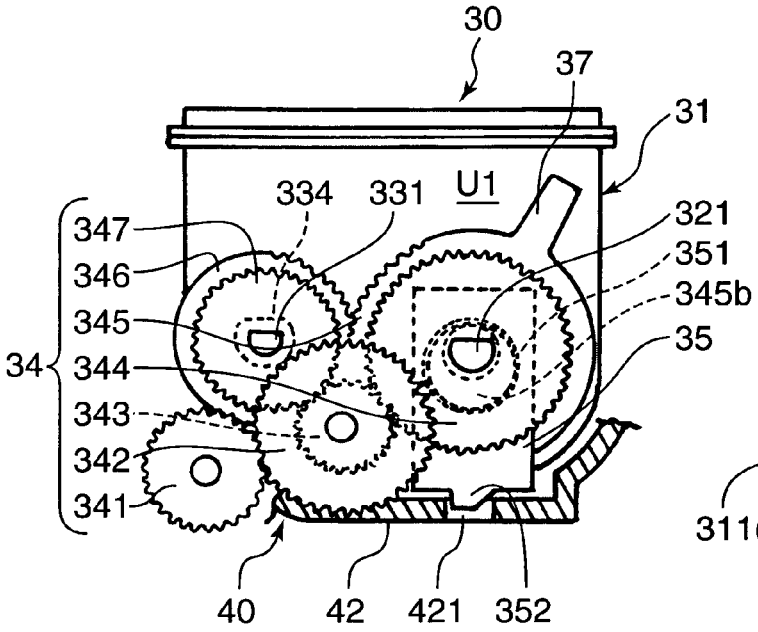
Figure 8B:
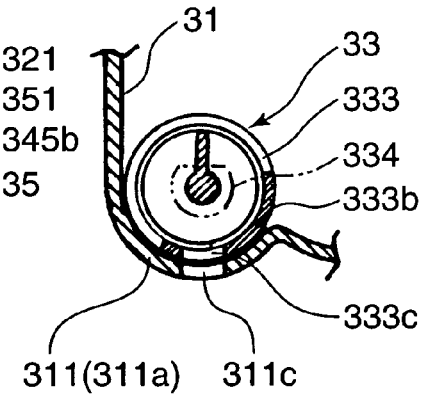

The lock plate 35 is pressed down by the round cam 345*b* by setting the operation knob 37 at an open position U1 (see FIGS. 8A, 8B). This causes the locking projection 352 to fit into a lock hole 421 formed in the bottom of a guide groove 42 of the platform 40, whereby the toner container 30 is so locked as not to come off the platform 40. On the other hand, the lock plate 35 moves upward by the eccentric rotation of the round cam 345*b* about the agitating shaft 321 upon displacing the operation knob 37 to a closed position U2 (see FIGS. 8C, 8D). The toner container 30 is freed from the interlocked state with the platform 40 by this upward movement of the lock plate 35.

The front lid 36 is for improving the appearance by covering the gear mechanism 34 and protecting the gear mechanism 34. The shape of such a front lid 36 in front view is set to substantially conform to the shape of the front plate 314 of the container case 31.

Such a front lid 36 is formed on the front surface thereof with a bulging portion 361 having a two-humped front view corresponding to the second and third driven gears 343, 344. A knob pull-out opening 362 through which the operation knob 37 is pulled out toward the front side of the front lid 36 is formed at a right upper side of this bulging portion 361. An arcuate opening 363 having a center of curvature located at the central axis of the first selector gear 345 (i.e. the central axis of the shaft tube 344*a*) extends in counterclockwise direction from the bottom end of the knob pull-out opening 362. The presence of the arcuate opening 363 enables the operation knob 37 projecting forward of the front lid 36 to be rotated in counterclockwise direction from the position of the knob pull-out opening 362.

A locking recess 364 into which a locking piece 483 (see FIG. 11A) of a lever member 48 to be described later is provided at the right side of the bottom edge of the front lid 36. Further, the corners which are at the left and right edges of the upper part of the front lid 36 and between the side surfaces and the front surface are dented, thereby forming grippable recesses 365. This pair of grippable recesses 365 are both dimensioned such that fingertips are insertable thereinto. Accordingly, as shown in FIG. 7, by inserting a thumb into one grippable recess 365 and an index finger into the other grippable recess 365 to grip the toner container 30, the toner container 30 mounted on the platform 40 can be easily detached from the platform 30.

Figure 8C:
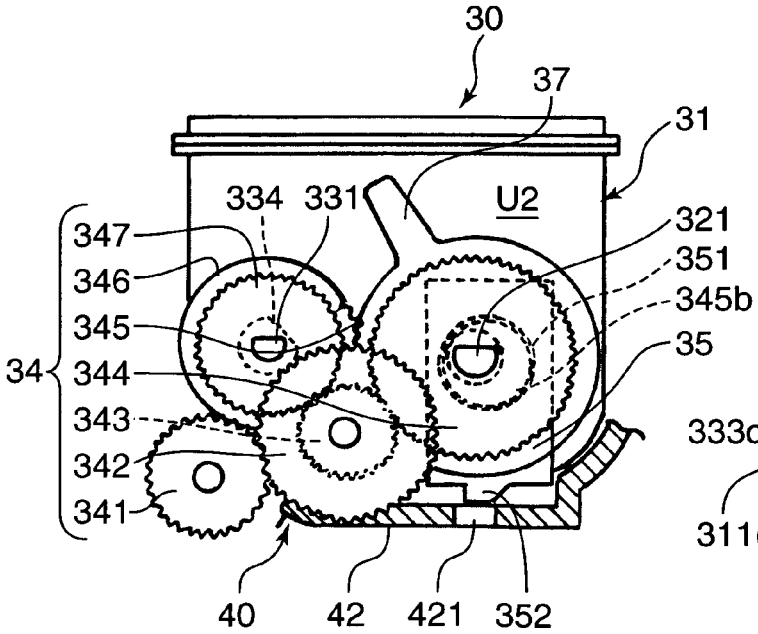
Figure 8D:
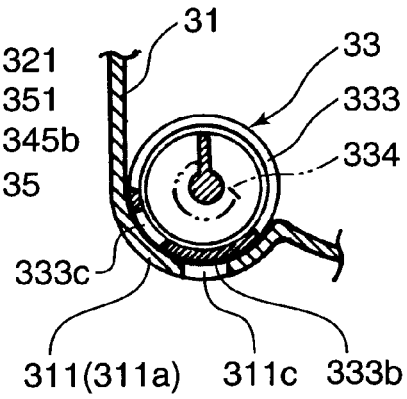

FIGS. 8A to 8D are diagrams showing the functions of the gear mechanism 34, wherein FIG. 8A is a front view showing a state where the operation knob 37 of the first selector gear 345 is set at the open position U1 to open the shutter member 33 with the front lid 36 detached, FIG. 8B is a section showing the state of the shutter member 33 at this time, FIG. 8C is a front view showing a state where the operation knob 37 of the first selector gear 345 is set at the closed position U2 to close the shutter member 33 with the front lid 36 detached, and FIG. 8D is a section showing the state of the shutter member 33 at this time.

As shown in FIG. 8A, with the operation knob 37 set at the open position U1 to be located at the right side of the container case 31 in front view, a maximally eccentric part of the round cam 345*b* of the first selector gear 345 faces downward with the central axis of the agitating shaft 321 as a base point. Thus, the lock plate 35 whose guidable hole 351 is fitted on the round cam 345*b* is moved downward to a locking position, causing the locking projection 352 to fit into the locking hole 421 of the guide groove 42, whereby the toner container 30 is interlocked with the platform 40 so as not to come out of the printer main body 11.

Further, with the operation knob 37 set at the open position U1, the oblong hole 333*c* of the cylindrical shutter member 33 faces the discharge opening 311*c* of the smaller arcuate bottom plate 311*a* of the container case 31 as shown in FIG. 8B. This enables toner particles in the container case 31 to be discharged through the oblong hole 333*c* and the discharge opening 311*c*.

Accordingly, if the drive gear 341 is driven and rotated by the unillustrated drive motor in this state, this rotation is transmitted to the third and fourth driven gears 344, 347 via the first and second driven gears 342, 343, thereby rotating the third and fourth driven gears 344, 347. The integral rotation of the third driven gear 344 about the agitating shaft 321 is transmitted to the agitating member 32 to agitate toner particles in the container case 31. Further, the integral rotation of the fourth driven gear 347 about the shutter shaft 331 is transmitted to the spiral fin 332 to move toner particles in the shutter cylinder 333 toward the oblong 333*c*. Thus, toner particles in the container case 31 can be efficiently discharged.

Upon replacing the toner container 30 having toner particles therein used up with a new one, the operation knob 37 set at the open position U1 is operated to left, thereby being changed to the closed position U2 as shown in FIG. 8C. By this position change, the first selector gear 345 relatively rotates in counterclockwise direction about the agitating shaft 321. This rotation causes the second selector gear 346 in mesh with the first selector gear 345 to integrally rotate in clockwise direction.

Since the shutter member 33 integrally rotates with the second selector gear 346 in clockwise direction about the bush 334 by the rotation of the second selector gear 346, the arcuate shutter plate 333*b* of the shutter member 33 closes the discharge opening 311*c* of the container case 31 as shown in FIG. 8D.

On the other hand, the round cam 345*b* is eccentrically rotated in counterclockwise direction about the agitating shaft 321 by the counterclockwise rotation of the first selector gear 345 about the agitating shaft 321 resulting from the position change of the operation knob 37 from the open position U1 to the closed position U2, and the locking projection 352 comes out of the locking hole 421 as shown in FIG. 8C by the resulting upward movement of the lock plate 35, thereby canceling the locked state. Thus, the toner container 30 can be detached from the printer main body 11. Upon this detachment, such an inconvenience that toner particles residual in the toner container 30 leaks through the oblong hole 333*c* can be prevented from occurring since the discharge opening 311 of the container case 31 is closed by the arcuate shutter plate 333*b* of the shutter member 33.

Figure 9:
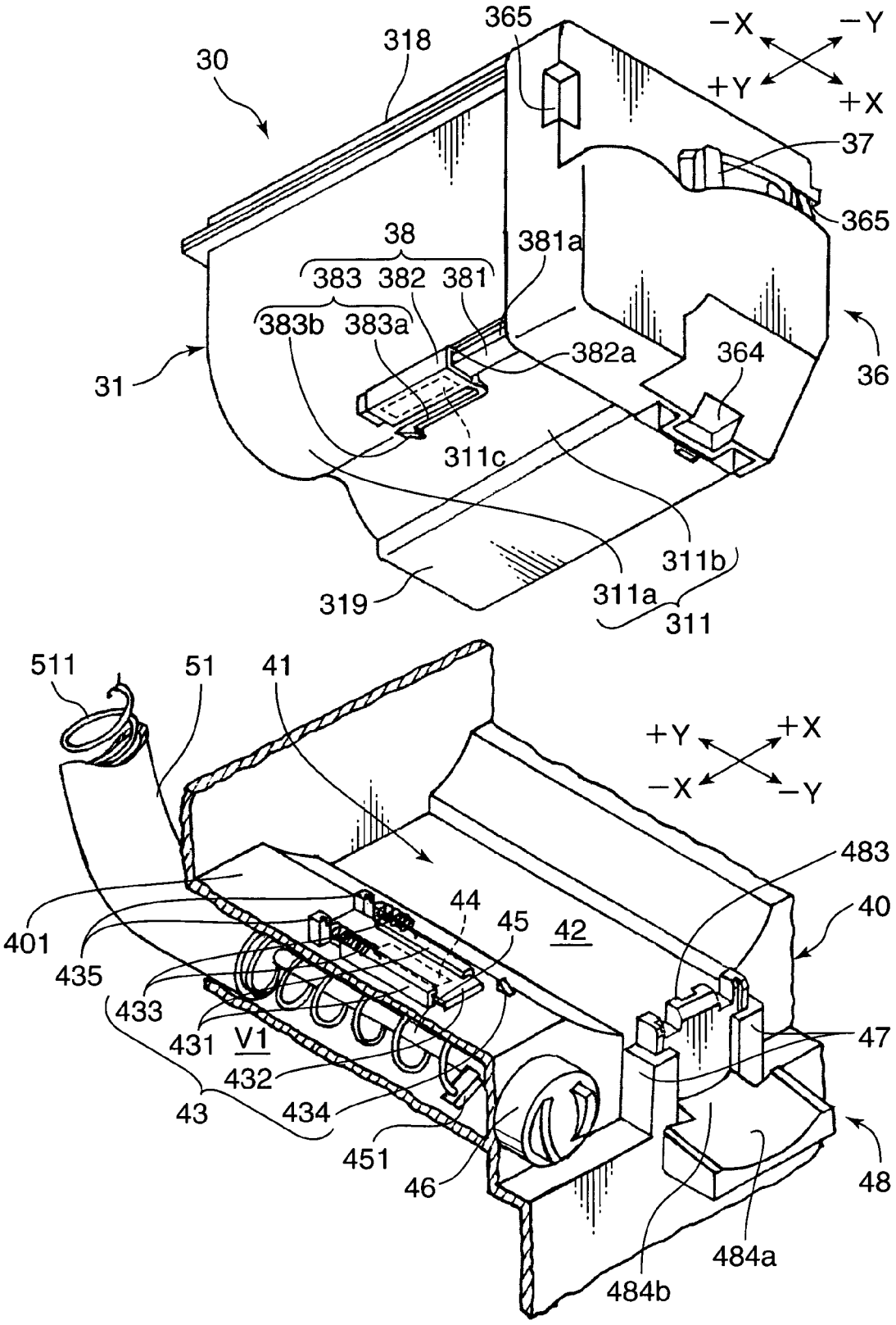
FIG. 9 is a partial perspective view showing one embodiment of the platform on which the toner container is to be mounted, with the toner container detached.
Figure 10:
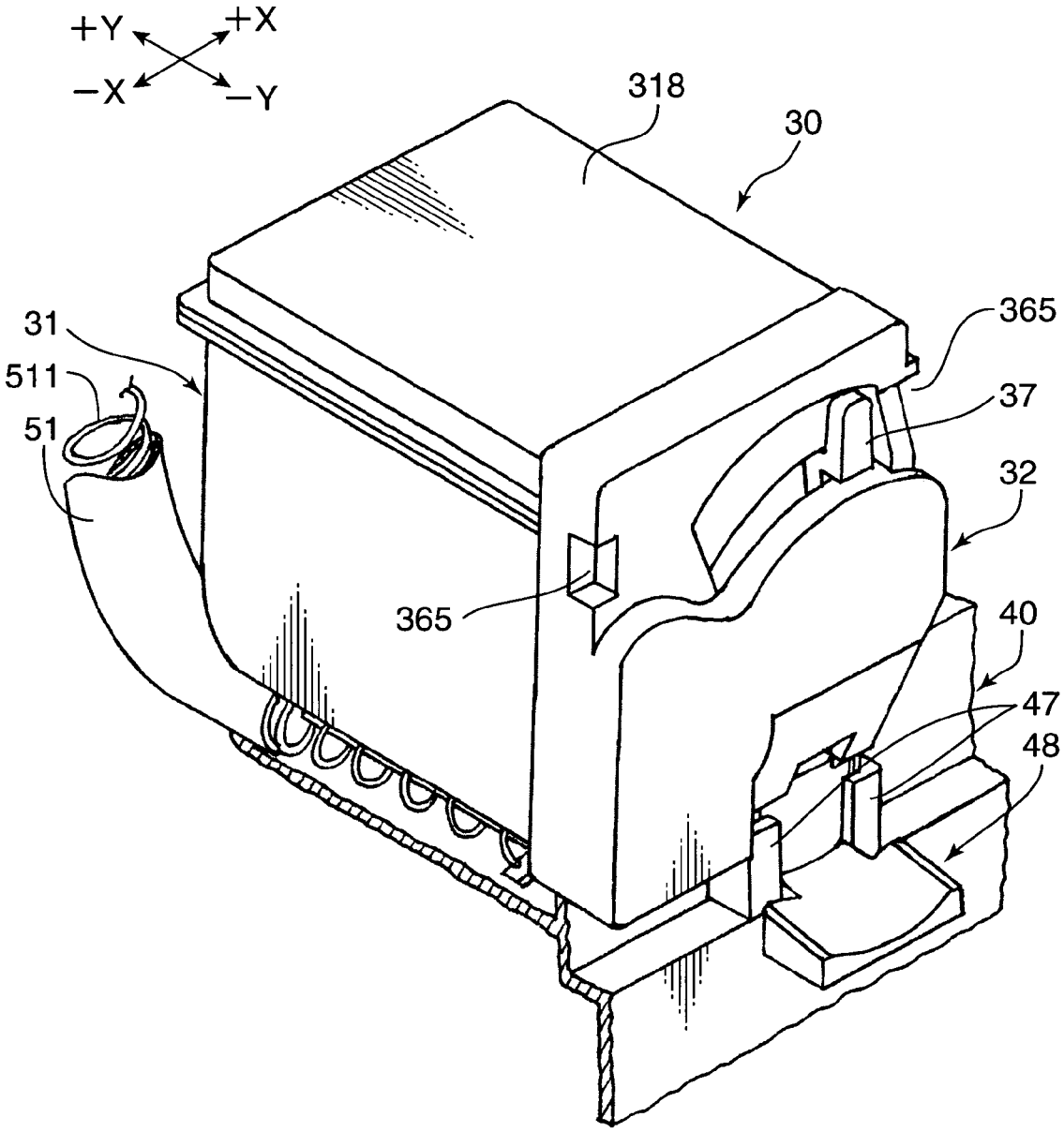
FIG. 10 is a partial perspective view showing the embodiment of the platform with the toner container mounted.

FIGS. 9 and 10 are partial perspective views showing one embodiment of the platform 40 on which the toner container 30 is to be mounted, wherein FIG. 9 shows a state where the toner container 30 is detached from the platform 40 and FIG. 10 shows a state where the toner container 30 is mounted on the platform 40. Directions indicated by X and Y in FIGS. 9 and 10 are similar to the case of FIGS. 1A to 1C (X are transverse directions (−X: leftward direction, +X: rightward direction) and Y are forward and backward directions (−Y: forward direction, +Y: backward direction)).

As shown in FIG. 9, a mounting recess 41 recessed in conformity with the shape of the larger arcuate bottom plate 311*b* of the toner container 30, having an arcuate shape in front view and extending in forward and backward directions is formed in the upper surface of the platform 40. A guide groove 42 extending in forward and backward directions is formed by recessing the bottom part of the mounting recess 41.

On the other hand, an elongated guidable projection 319 extending in forward and backward directions and to be guided by being fitted in the guide groove 42 as shown in FIG. 9 is provided on the outer surface of the larger arcuate bottom plate 311*b* of the bottom plate 311 of the container case 31. The toner container 30 is pushed backward with the guidable projection 319 fitted in the guide groove 42, thereby being mounted on the platform 40 while being positioned and guided by the guide groove 42.

A container-side shutter device 38 is mounted at a position of the smaller arcuate bottom plate 311*a* of such a container case 31 corresponding to the discharge opening 311*c*. The container-side shutter device 38 includes a guide plate 381 extending backward from the front edge of the smaller arcuate bottom plate 311*a*, a U-shaped shutter plate 382 engaged with this guide plate 381 in such a manner as to be movable in forward and backward directions and being U-shaped in front view, and a locking arm 383 extending backward from a front position of the right end of the U-shaped shutter plate 382.

A guiding groove 381*a* extending in forward and backward directions is formed by recessing each of the left and right surfaces of the guide plate 381. Guidable edge portions 382*a* fittable in the corresponding guiding grooves 381*a* while being held in sliding contact therewith are provided at the upper ends of the respective left and right plates of the U-shaped shutter plate 382. By fitting each of the pair of guidable edge portions 382*a* into the corresponding one of the pair of guiding grooves 381*a*, the U-shaped shutter plate 382 can reciprocate in forward and backward directions along the guide plate 381. Further, an opening having the same size as the discharge opening 311*c* of the container case 31 is formed at a position of the guide plate 381 facing the discharge opening 311*c* (hereinafter, the discharge opening 311*c* also includes this opening).

The length of the U-shaped shutter plate 382 is set such that the U-shaped shutter plate 382 closes the discharge opening 311*c* upon being moved backward along the guide plate 381 while opening the discharge opening 311*c* upon being moved forward along the guide plate 381.

The locking arm 383 is comprised of an arm main body 383*a* extending in forward and backward directions and having the base end (front end) thereof integrally fixed to the U-shaped shutter plate 382, and a container-side locking claw 383*b* projecting downward at the leading end (rear end) of the arm main body 383*a*. The arm main body 383*a* is set to have substantially the same length as the U-shaped shutter plate 382 and is elastically deformable to take an arched posture. Further, the container-side locking claw 383*b* is in the form of the tip of a fish hook by being pointed toward the rear end and provided with a barb.

On the other hand, a ceiling plate 401 at the left side of the platform 40 is provided with a receiving opening 44 for receiving toner particles discharged through the discharge opening 311*c* at a position facing the discharge opening 311*c*, and a platform-side shutter device 43 facing the container-side shutter device 38 while covering the receiving opening 44.

The platform-side shutter device 43 includes a pair of left and right inverted L-shaped guide rails 431 arranged at positions slightly more outward than the left and right edges of the receiving opening 44 in the ceiling plate 401, a platform-side shutter plate 432 movable forward and backward while being embraced by the pair of inverted L-shaped guide rails 431, a pair of coil springs 433 for biasing the platform-side shutter plate 432 forward to close the receiving opening 44, and a platform-side locking claw 434 projecting at the front side of the right edge of the ceiling plate 401 in such a manner as to face the container-side locking claw 383*b* of the container-side shutter device 38.

The platform-side shutter plate 432 is provided with a pair of supporting projections 435 projecting upward from the left and right edges of the rear end thereof. The respective coil springs 433 are mounted between the supporting projections 435 and the inverted L-shaped guide rails 431 while being stretched. Accordingly, as shown in FIG. 9, the platform-side shutter plate 432 closes the receiving opening 44 by being subjected to biasing forces of the pair of coil springs 433 without the toner container 30 being mounted on the platform 40.

The positions of the pair of inverted L-shaped guide rails 431 and the U-shaped shutter plate 382 are set to have such a relative positional relationship as to interfere with each other as the guidable projection 319 of the toner container 30 is fitted into the guide groove 42 from the front end of the platform 40. Further, a spacing between the upper edges of the pair of inverted L-shaped guide rails 431 is set to be slightly larger than the transverse width of the guide plate 381.

If being pushed backward with the guidable projection 319 fitted at the front end of the guide groove 42, the toner container 30 moves backward while being guided by the guide groove 42 and consequently reaches a state mounted on the platform 40 as shown in FIG. 10. Both the U-shaped shutter plate 382 and the platform-side shutter plate 432 are opened by this mounting operation. This opening operation is described later with reference to FIG. 12.

A relay space V1 for relaying the conveyance of toner particles falling down through the receiving opening 44 is defined below the ceiling plate 401. An upstream end opening of the toner transferring pipe 51 is located at the rear end of this relay space V1. In the relay space V1 is provided a drive shaft 45 rotatable about a central axis thereof by being driven by a specified drive motor and extending in forward and backward directions. The front end of this drive shaft 45 projects out through the front wall of the platform 40. A connecting member 46 corresponding to the connecting projection 341*b* (see FIG. 6) of the drive gear 341 is provided at the front end of such a drive shaft 45. The rear end of the drive shaft 45 is a free end in the relay space V.

By mounting the toner container 30 in the mounting recess 41 of the platform 40, the drive gear 341 of the toner container 30 is coupled to the drive shaft 45 via the connecting projection 341*b* and the connecting member 46 (see FIG. 7).

A projecting piece 451 projecting in radial direction is provided at the front end of the drive shaft 45. This projecting piece 451 is integrally coupled to the front end of the spiral feeder 511. Thus, the driven rotation of the spiral feeder 511 caused by the transmission of a driving force from a unillustrated driving source is transmitted to the drive shaft 45 via the projecting piece 451. Accordingly, by mounting the toner container 30 into the mounting recess 41, the driving force of the specified driving source is simultaneously transmitted to the gear mechanism 34 of the toner container 30 and the spiral feeder 511 in the toner transferring pipe 51 via the connecting member 46.

The front wall of the platform 40 is provided with a pair of left and right guide pieces 47 extending in vertical direction at positions corresponding to the guide groove 42, and with the lever member 48 movable upward and downward while being guided by this pair of guide pieces 47. The guide pieces 47 are L-shaped when being viewed at the end surfaces thereof, and the lever member 48 is movable upward and downward while being prevented from coming out forward by being embraced by the pair of L-shaped guide pieces 47.

Figure 11A:
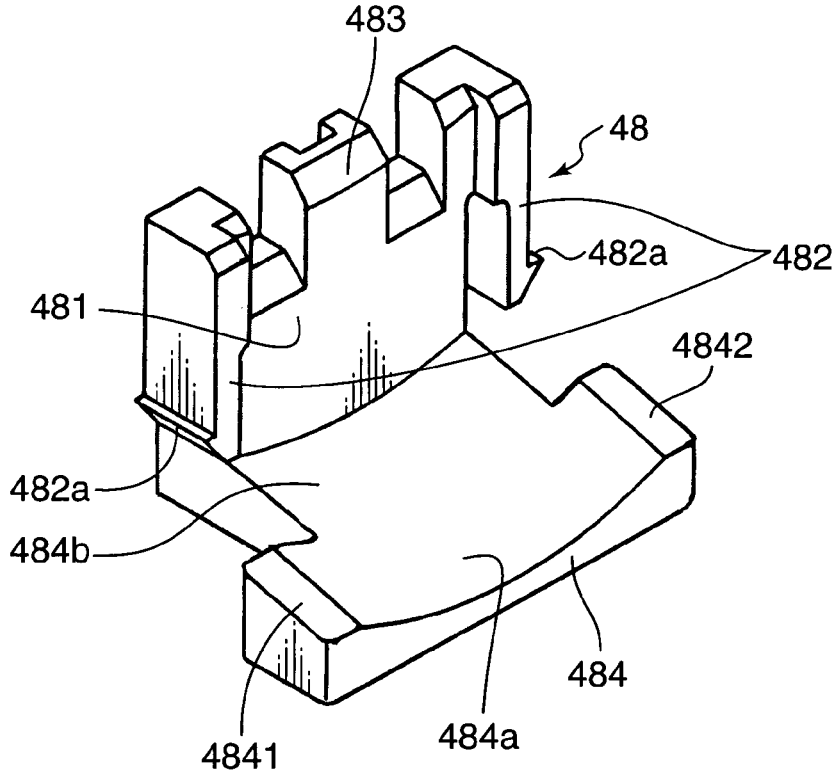
FIGS. 11A, 11B are a perspective view and a section showing one embodiment of a lever member.
Figure 11B:
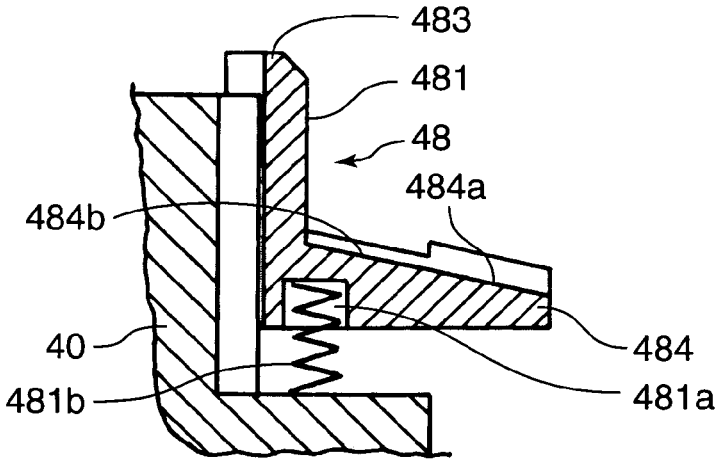

FIGS. 11A and 11B are a perspective view and a section showing one embodiment of the lever member 48, respectively. The lever member 48 shown in FIG. 11A is for retaining the toner container 30 mounted in the mounting recess 41 of the platform 40 and canceling the retained state by its operation. Such a lever 48 includes an elevating piece 481 tightly held between the pair of guide pieces 47 in such a manner as to be movable upward and downward, a pair of arm pieces 482 projecting outward from the opposite sides of the elevating piece 481 and extending in vertical direction, the locking piece 483 projecting upward from the upper edge of the elevating piece 481, and an operation lever 484 projecting forward from the bottom edge of the elevating piece 481.

The pair of arm pieces 482 are fixed to the elevating piece 481 only at their upper parts, and bottom parts thereof are separated from the side edges of the elevating piece 481. Thus, the respective arm pieces 482 are elastically deformable in such directions as to move the bottom parts thereof toward each other. Locking claws 482*a* projecting in opposite directions are provided at the bottom ends of the pair of arm pieces 482. When the elevating piece 481 is once inserted between the guide pieces 47, these locking claws 482*a* are fitted into unillustrated locking grooves formed in the opposite surfaces of the guide pieces 47, thereby preventing the elevating piece 481 from coming out upward.

As shown in FIG. 11B, a mounting recess 481*a* is formed in the lower surface of the elevating piece 481 by making a cut extending upward from the bottom edge. A coil spring 481*b* (biasing means) is mounted in a compressed state into this mounting recess 481*a*, whereby the lever member 481 is biased upward while being mounted between the guide pieces 47. A projecting amount of the locking piece 483 is set such that the locking piece 483 projects upward from the guide groove 42 while being biased in such a manner.

The operation lever 484 includes a constricted portion (projecting member) 484*b* projecting forward from a bottom end position of the elevating piece 481 and having a transverse width set to be equal to that of the elevating piece 481, and an operation surface 484*a* integrally formed to project forward from the front end of the constricted portion 484*b*. The constricted portion 484*b* is located at a position between the L-shaped edges of the pair of guide pieces 47 and the operation surface 484*a* is located at a position projecting forward from the platform 40.

The upper surfaces of the constricted portion 484*b* and the operation surface 484*a* are formed into such arcuate surfaces that the transverse middle portions thereof are located at bottommost positions. These arcuate surfaces are such moderate concave surfaces that the bulb of a finger can fit without any sense of discomfort. An arcuate surface continuous from the constricted portion 484*b* to the operation surface 484*a* is sloped downward toward the front as shown in FIG. 11B. The operation surface 484*a* is wider than the constricted portion 484*b*, and flat inclined portions 4841, 4842 are formed at the opposite left and right ends thereof. By forming such an arcuate surface, the operation lever 48 can be pressed without any problem even if the fingernail is long when the operation surface 484*a* is pushed with the fingertip. It should be noted that, instead of providing the above arcuate surfaces, the upper surfaces of the constricted portion 484*b* and the operation surface 484*a* may be formed into flat inclined surfaces sloped downward toward the front.

Figure 12A:
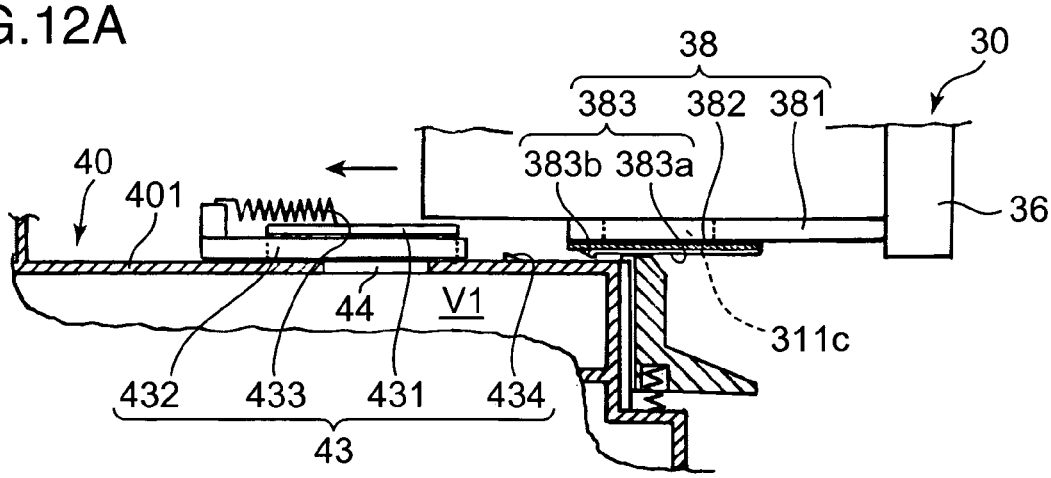
FIGS. 12A to 12D are diagrams showing a relationship between a container-side shutter device, a platform-side shutter device and the lever member to depict the relative functions thereof.
Figure 12B:
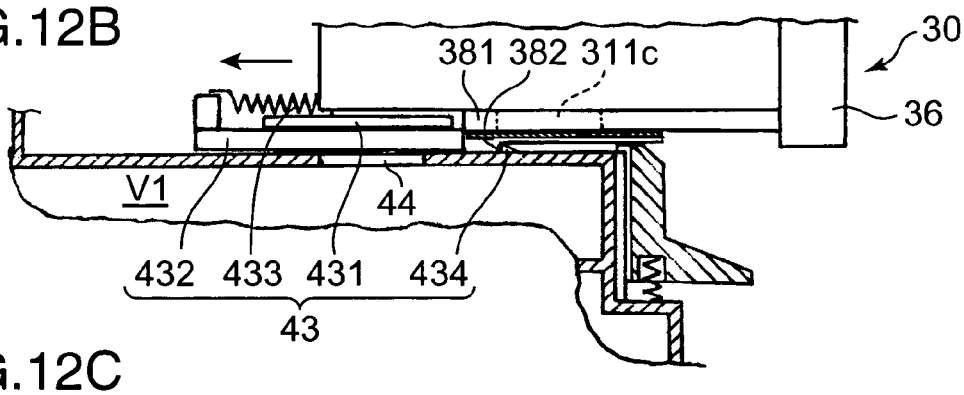
Figure 12C:
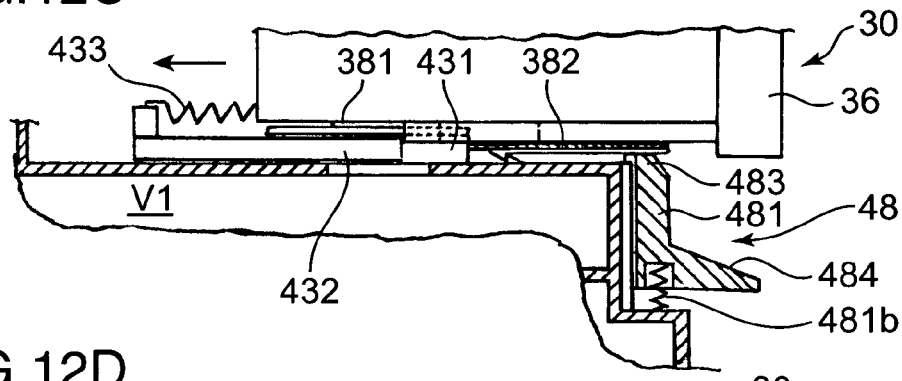
Figure 12D:
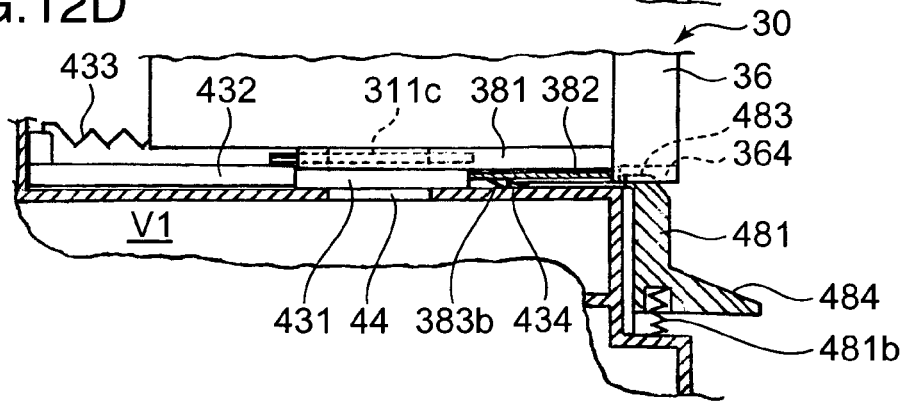

Mutually related relative functions of the container-side shutter device 38, the platform-side shutter device 43 and the lever member 48 are described below with reference to FIGS. 12A to 12D. FIGS. 12A to 12D are diagrams showing the relationship of the container-side shutter device 38, the platform-side shutter device 43 and the lever member 48 to depict the relative functions thereof. FIG. 12A shows a state where the rear end of the toner container 30 faces the front end of the platform 40; FIG. 12B shows a state, attained by moving the toner container 30 backward, where the rear end of the U-shaped shutter plate 382 is in contact with the front ends of the inverted L-shaped guide rails 431; FIG. 12C shows a state, reached by further moving the toner container 30 backward, where the platform-side shutter plate 432 is opened against the biasing forces of the coil springs 433 and the U-shaped shutter plate 382 is also being opened; and FIG. 12D shows a state where both the U-shaped shutter plate 382 and the platform-side shutter plate 432 are opened.

First, in the state shown in FIG. 12A, the receiving opening 44 formed in the ceiling plate 401 of the platform 40 is closed by the platform-side shutter plate 432 moved to right by the biasing forces of the coil springs 433.

If the toner container 30 is pushed backward (to left in the plane of FIG. 12A) in this state, the leading end of the guide plate 381 of the container-side shutter device 38 first comes into contact with the platform-side shutter plate 432 of the platform-side shutter device 43 and the U-shaped shutter plate 382 of the container-side shutter device 38 faces the inverted L-shaped guide rails 431 of the platform-side shutter device 43 at a proximate position as shown in FIG. 12B. Further, at this time, the container-side locking claw 383*b* of the locking arm 383 passes over the platform-side locking claw 434 by the elastic deformation of the arm main body 383*a* caused the interference of the container-side locking claw 383*b* with the platform-side locking claw 434, and is located behind (at the left side in the plane of FIG. 12B) the platform-side locking claw 434.

If the toner container 30 continues to be pushed relative to the platform 40 in this state, the guide plate 381 pushes the platform-side shutter plate 432 backward, whereby the platform-side shutter plate 432 moves backward against the biasing forces of the coil springs 433, thereby gradually opening the receiving opening 44. Contrary to this, the U-shaped shutter plate 382 does not move following the backward movement of the guide plate 381 since being held in contact with the inverted L-shaped guide rails 431 of the platform-side shutter device 43. Conversely, since the U-shaped shutter plate 382 is moved backward relative to the guide plate 381, the discharge opening 311*c* is gradually opened as shown in FIG. 12C.

With the toner container 30 pushed to the backmost position of the platform 40, the platform-side shutter plate 432 is located at its backmost position to fully open the receiving opening 44 as shown in FIG. 12D. Further, the U-shaped shutter plate 382 is moved to its frontmost position relative to the guide plate 381 to fully open the discharge opening 311*c*. Thus, toner particles in the toner container 30 is discharged to the relay space V1 below the platform 40 through the discharge opening 311*c* and the receiving opening 44.

Upon moving the toner container 30 from the state shown in FIG. 12C to the state shown in FIG. 12D, a slanted portion at the front upper edge of the locking piece 483 of the lever member 48 interferes with the bottom edge of the front lid 36 of the toner container 30 and is fitted into the locking recess 364 (locking position) after moving downward once against the biasing force of the coil spring 481*b*. In this way, the toner container 30 is prevented from coming out forward as shown in FIG. 12D.

Upon detaching the toner container 30 from the platform 40, the upper surface (constricted portion 484*b* and operable surface 484*a*) of the operation lever 484 may be pressed down by the finger after the operation knob 37 is operated to left as shown in FIG. 8C to close the discharge opening 311*c* at the inner side as already described with reference to FIGS. 8A to 8D. In this way, the locking piece 483 of the lever member 48 is disengaged from the locking recess 364 of the front lid 36 of the toner container 30, whereby the toner container 30 is pushed outward from the platform 40 by the biasing forces of the platform-side shutter plate 432.

Further, since the container-side locking claw 383*b* of the locking arm 383 of the toner container 30 is engaged with the platform-side locking claw 434 when the toner container 30 is detached from the platform 40, the U-shaped shutter plate 382 is moved relative to the guide plate 381, whereby the discharge opening 311*c* is closed by the U-shaped shutter plate 382. Accordingly, the scattering of toner particles residual in the toner container 30 to the outside through the discharge opening 311*c* can be effectively prevented when the toner container 30 is detached from the platform 40.

As described in detail above, in the printer 10 according to the present invention, the toner containers 30 for replenishing the rotary developing unit 20 with toner particles are detachably mountable into the printer main body 11, and the operation levers 484 are provided to interlock the toner containers 30 with the printer main body 11 using the biasing forces of the coil springs 481*b* and pressed down against the biasing forces of the coil springs 481*b* to unlock the toner containers 30. Each operation lever 484 has the arcuate operation surface 484*a* to be pressed by the fingertip, and this operation surface 484*a* is sloped downward toward the front side where an operator would face. Thus, even if the fingernails of the operator are long, the fingertip faces obliquely upward while touching the operation surface 484*a*, whereby the interference of the fingernail with the surrounding environment (specifically, the elevating piece 481 of the lever member 48) can be avoided. Therefore, the operation lever 484 can be easily pressed.

Thus, unlike the prior art, such an inconvenience of being difficult to press the operation lever 484, for example, when the fingernails are long and being unable to easily detach the toner containers 30 from the printer main body 11 can be securely solved.

Further, the operation surface 484*a* of the lever member 48 is formed at the leading end of the constricted portion 484*b* projecting a specified length from a specified wall surface of the printer main body 11. Thus, the operation surface 484*a* is distanced from the wall surface just by that much and the interference of the long fingernail with the wall surface can be more securely prevented, wherefore the operability of the operation lever 484 can be further improved.

Further, since a plurality of kinds of toner containers 30 filled with toner particles of different colors are employed, the toner containers 30 of the respective colors can be easily replaced in the printer 10 capable of performing color printing.

The present invention is not limited to the above embodiment, and also embraces the following contents.

Although the printer 10 is described as an example of the image forming apparatus in the above embodiment, the image forming apparatus according to the present invention is not limited to the printer 10 and may be a copier or a facsimile machine.

Although the rotary developing unit 20 is employed as the developing device and one photoconductive drum 131 is used for this rotary developing unit 20 in the above embodiment, the developing device according to the present invention is not limited to the rotary developing unit 20 and four ordinary developing devices and four photoconductive drums may be employed.

The aforementioned specific embodiment mainly embraces features of the inventions having the following constructions.

An image forming apparatus according to one aspect of the present invention comprises an apparatus main body provided with a developing device, a toner container detachably mountable into the apparatus main body and adapted to replenish the developing device with toner particles, and a lever member settable to a locking position by a biasing force of a specified biasing member to interlock the toner container with the apparatus main body while being pressed down against the biasing force of the biasing member to unlock the toner container, the lever member having an operation surface to be pressed, and the operation surface including an inclined surface sloped downward toward a side where an operator would face.

With such a construction, the inclined surface sloped downward toward the side where the operator would face is formed on the operation surface to be pressed by a fingertip in the lever member operated to cancel the interlocked state of the toner container with the apparatus main body. Thus, even if the fingernails of the operator are long, the fingertip faces obliquely upward while touching the operation surface, the interference of the fingernail with the surrounding members can be avoided, wherefore the lever member can be easily pressed. Accordingly, unlike the prior art, such an inconvenience of being difficult to press the operation lever, for example, when the fingernails are long and being unable to easily detach the toner container from the apparatus main body can be securely solved.

In the above construction, the operation surface is preferably formed on a projecting member projecting a specified length from a specified wall surface of the apparatus main body. With such a construction, the operation surface is distanced from the wall surface just by that much since being formed at the leading end of the projecting member projecting the specified length from the specified wall surface of the apparatus main body. Therefore, the interference of the long fingernail of the operator with the wall surface can be more securely prevented.

It is further preferable that the lever member includes an elevating piece movable upward and downward along a guide piece provided on the apparatus main body and an operation lever projecting from the bottom edge of the elevating piece toward the side where the operator would face, that a locking portion for interlocking the toner container with the apparatus main body is provided atop the elevating piece, that the biasing member is arranged on the lower surface of the elevating piece and that the operation surface is provided on the upper surface of the operation lever. With this construction, the lever member can be simply and inexpensively constructed.

In such a case, it is preferable that the operation lever includes a projecting member projecting forward toward the side where the operator would face from a bottom end position of the elevating piece and having a transverse width set to be equal to that of the elevating piece, and an operation surface integrally formed to project forward from the front end of the projecting member, and that a surface extending from the upper surface of the projecting member to the operation surface is the inclined surface sloped downward toward the front.

In the above construction, the operation surface is preferably a concave arcuate surface sloped downward toward the front. With this construction, the bulb of the finger can fit the operation surface without any sense of discomfort and operability can be improved.

Further, in the above construction, a plurality of kinds of toner containers filled with toner particles of different colors may be juxtaposed in the apparatus main body and each toner container may be provided with the operation lever. With this construction, since a plurality of kinds of toner containers filled with toner particles of difference colors are employed, the toner containers of the respective colors can be easily replaced in the image forming apparatus capable of performing color printing.

This application is based on patent application No. 2005-288990 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus, comprising:

an apparatus main body including a developing device, a toner container detachably mountable into the apparatus main body and adapted to replenish the developing device with toner particles, and a lever member settable to a locking position by a biasing force of a specified biasing member to interlock the toner container with the apparatus main body while being pressed down against the biasing force of the biasing member to unlock the toner container, wherein the lever member includes an elevating piece movable upward and downward along a guide piece provided on the apparatus main body, an operation lever projecting from a bottom edge of the elevating piece toward a side where an operator would face, and an operation surface to be pressed, the operation surface being provided on an upper surface of the operation lever, and having an inclined surface sloped downward toward the side where the operator would face.

2. The image forming apparatus according to claim 1, wherein the operation surface is formed on a projecting member projecting a specified length from a specified wall surface of the apparatus main body.

3. The image forming apparatus according to claim 1, wherein:

a locking portion for interlocking the toner container with the apparatus main body is provided atop the elevating piece, and the biasing member is arranged on a lower surface of the elevating piece.

4. The image forming apparatus according to claim 3, wherein:

the operation lever includes a projecting member projecting forward toward the side where the operator would face from a bottom end position of the elevating piece and having a transverse width set to be equal to that of the elevating piece, and an operation surface integrally formed to project forward from the front end of the projecting member, and a surface extending from the upper surface of the projecting member to the operation surface is the inclined surface sloped downward toward the front.

5. The image forming apparatus according to claim 1, wherein the operation surface is a concave arcuate surface sloped downward toward a front.

6. The image forming apparatus according to claim 1, wherein:

a plurality of kinds of toner containers filled with toner particles of different colors are juxtaposed as the toner containers in the apparatus main body, and each toner container is provided with the lever member.

7. The image forming apparatus according to claim 1, wherein the operation lever has a lower surface opposite the upper surface, the lower surface of the operation lever being aligned substantially perpendicular to the elevating piece, the upper surface being aligned at an angle greater than 90° to the elevating piece so that the upper surface converges toward the lower surface of the operation lever at farther distances from the elevating piece.

8. An image forming apparatus, comprising:

an apparatus main body including a developing device;

a toner container detachably mountable into the apparatus main body and adapted to replenish the developing device with toner particles; and a lever member settable to a locking position by a biasing force of a specified biasing member to interlock the toner container with the apparatus main body while being pressed down against the biasing force of the biasing member to unlock the toner container with the apparatus main body while being pressed down against the biasing force of the biasing member to unlock the toner container, wherein the lever member includes:

an elevating piece movable upward and downward along a guide piece provided on the apparatus main body, an operation lever projecting from a bottom edge of the elevating piece toward a side where an operator would face, and an operation surface to be pressed, wherein the operation lever has:

a projecting member projecting forward toward the side where the operator would face from a bottom end position of the elevating piece, and having a transverse width set to be equal to that of the elevating piece, and an operation surface integrally formed to project forward from the front end of the projecting member, a surface extending from an upper surface of the projecting member to the operation surface is an inclined surface sloped downward toward a front, a locking portion for interlocking the toner container with the apparatus main body is provided atop the elevating piece, and the biasing member is arranged on a lower surface of the elevating piece.

9. An image forming apparatus, comprising:

an apparatus main body including a developing device, a toner container detachably mountable into the apparatus main body and adapted to replenish the developing device with toner particles, a substantially L-shaped lever member having an elevating piece with opposite top and bottom ends, the elevating piece being movable up and down along a guide piece on the apparatus main body, the lever member further having an operation lever projecting from the bottom end of the elevating piece, the operation lever having a lower surface and an upper surface inclined to slope down toward the lower surface at farther distances from the elevating piece to define an operation surface that can be pressed at locations spaced from the elevating piece; and a biasing member extending between the apparatus main body and the lower surface of the operation lever for biasing the lever member into a position for interlocking the toner container with the apparatus main body.

10. The image forming apparatus according to claim 9, wherein the operation surface is concave.

* * * * *